US009293096B2

(12) United States Patent
Kouno et al.

(10) Patent No.: US 9,293,096 B2
(45) Date of Patent: Mar. 22, 2016

(54) IMAGE DISPLAY DEVICE, AND IMAGE DISPLAY METHOD USED FOR SAME

(75) Inventors: Makoto Kouno, Kawasaki (JP); Hiroaki Kimura, Kawasaki (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 1326 days.

(21) Appl. No.: 12/255,302

(22) Filed: Oct. 21, 2008

(65) Prior Publication Data

US 2009/0102769 A1 Apr. 23, 2009

(30) Foreign Application Priority Data

Oct. 23, 2007 (JP) ..... 2007-275741

(51) Int. Cl.
*G09G 3/00* (2006.01)
*G09G 3/36* (2006.01)

(52) U.S. Cl.
CPC ..... *G09G 3/3648* (2013.01); *G09G 2300/0452* (2013.01); *G09G 2320/0276* (2013.01); *G09G 2340/06* (2013.01)

(58) Field of Classification Search
CPC ..... G09G 3/3648; G09G 2300/0452
USPC ..... 345/603, 77
See application file for complete search history.

(56) References Cited

U.S. PATENT DOCUMENTS

| | | | | |
|---|---|---|---|---|
| 7,705,810 | B2 * | 4/2010 | Choi et al. | 345/77 |
| 2004/0222999 | A1 | 11/2004 | Choi et al. | |
| 2006/0268003 | A1 * | 11/2006 | Tanase et al. | 345/603 |

FOREIGN PATENT DOCUMENTS

| | | | |
|---|---|---|---|
| CN | 1551707 | A | 12/2004 |
| JP | 2004-286814 | A | 10/2004 |
| JP | 2004-295086 | A | 10/2004 |
| JP | 2004-334199 | A | 11/2004 |
| JP | 2005-309436 | A | 11/2005 |
| JP | 2006-133711 | A | 5/2006 |
| JP | 2006-317898 | A | 11/2006 |
| JP | 2006-317899 | A | 11/2006 |
| JP | 2007-041595 | A | 2/2007 |

OTHER PUBLICATIONS

Office Action issued by the Japanese Patent Office in Japanese Application No. 2007-275741 dated Jul. 24, 2012.
Japanese Office Action issued Nov. 26, 2013 in corresponding Japanese Patent Application No. 2013-006788.

* cited by examiner

*Primary Examiner* — Amare Mengistu
*Assistant Examiner* — Joseph G Rodriguez
(74) *Attorney, Agent, or Firm* — Sughrue Mion, PLLC

(57) ABSTRACT

An image display device is provided which is capable of improving reproducibility of a white color. An RGB video signal is converted by a gamma converting section into three color luminance values and the maximum luminance value and minimum luminance value of the three color luminance values are calculated by a Min/Max calculating section. The first four color luminance values are calculated by an RGB luminance calculating section. A scaling factor is calculated by a scaling factor calculating section based on the first four color luminance values and the maximum luminance value. The second four color luminance values are calculated by an RGBW scaling luminance calculating section based on the first four color luminance values and on the scaling factor. An RGBW video signal corresponding to a gray level value of four color is generated by a reverse gamma converting section.

8 Claims, 12 Drawing Sheets

IMAGE DISPLAY DEVICE, AND IMAGE DISPLAY METHOD USED FOR SAME

INCORPORATION BY REFERENCE

This application is based upon and claims the benefit of priority from Japanese Patent Application No. 2007-275741, filed on Oct. 23, 2007, the disclosure of which is incorporated herein in its entirely by reference.

BACKGROUND OF THE INVENTION

1. Field of the Invention

The present invention relates to an image display device, image display method to be used for the image display device, and more particularly to the image display device suitably employed when each pixel of a display panel such as a liquid crystal panel made up of sub-pixels of three primary colors that produce a white color by additive mixture and a sub-pixel of a white color, the image display method to be used for the image display device, such as a liquid crystal display device.

2. Description of the Related Art

In an image display device such as a liquid crystal television set, three primary colors of red (R), green (G), and blue (B) are generally used as basic colors and a color image is displayed by controlling a gray level of each of these three primary colors and by mixing these colors. The image display device as described above obtains white by outputting a specified amount of each of the R, G, and B and performing the additive mixture of colors. However, luminance of the white color produced by the color mixture of these three colors lowers due to its passage through a color layer making up a color filter. In order to mitigate this problem, a related image display device has been proposed which is so configured that its luminance is improved by making up each pixel of its display panel using sub-pixels of R, G, and B that are made to pass through the color layer and a sub-pixel of white (W) that is not made to pass through the color layer.

As related technology of this type, a display device is disclosed in Patent Reference 1 [Japanese Patent Application Laid-open No. 2004-295086 (Page 11 and FIG. 12)] in which, when it is presumed that each of R, G, and B making up an RGB video signal is made up of 8 bit data width (gray level values are 0, 1, . . . , 254, 255), that each of the gray level values is, for example, 255 for R, 217 for G, and 186 for B, and that each gamma (γ) corresponding to the display panel is 2.2; as shown in FIG. 13, in a gamma conversion processing (Step A1), each gray level value of R, G, and B making up the RGB video signal is converted respectively into each of luminance values $R_0$, $G_0$, and $B_0$ (0 to 1) by the following equation:

$$R_0=[R/(\text{total gray level number}-1)]^{\gamma}=[255/(256-1)]^{2.2}=1$$

$$G_0=[G/(\text{total gray level number}-1)]^{\gamma}=[217/(256-1)]^{2.2}\approx 0.7$$

$$B_0=[B/(\text{total gray level number}-1)]^{\gamma}=[186/(256-1)]^{2.2}\approx 0.5 \qquad \text{Equation (1)}$$

In a position coordinate calculating processing (Step A2), position coordinates of an RGB video signal in a Gamut region are calculated and the maximum luminance value $M_1$ and minimum luminance value $M_2$ of the luminance values $R_0$, $G_0$, and $B_0$ obtained by the equation (1) are calculated by the following equation (2):

$$M_1=\text{Max}(R_0,G_0,B_0)=1$$

$$M_2=\text{Min}(R_0,G_0,B_0)=0.5 \qquad \text{Equation (2)}$$

In a scaling calculation processing (Step A3), to which portion of the Gamut region an RGB video signal belongs is judged and a scaling value S1 required to convert the maximum luminance value $M_1$ and minimum luminance value $M_2$ into a luminance value of each of R, G, and B in a region where the luminance has been expanded by the addition of a white sub-pixel is calculated by the following equation (3):

Region selection: $M_1-2\times M_2=1-2\times 0.5=0$

Judging condition: since the value is not >0, the routine proceeds to "NO" step and, therefore, $S_1=2$ Equation (3)

In an RGB increased value calculating processing (Step A4), a luminance value of each of the R, G, and B in the region where the luminance has been expanded is calculated from the luminance values $R_0$, $G_0$, and $B_0$ and the scaling value $S_1$ is obtained by the following equation (4):

$$R_2=S_1\times R_0=2\times 1=2$$

$$G_2=S_1\times G_0=2\times 0.7=1.4$$

$$B_2=S_1\times B_0=2\times 0.5=1 \qquad \text{Equation (4)}$$

In a white color signal extraction processing (Step A5), a white color signal is extracted from the luminance values $R_2$, $G_2$, and $B_2$ and a white color luminance value $W_{out}$ is calculated by the following equation (5):

$$W_{out}=\text{Min}(R_2,G_2,B_2)=1 \qquad \text{Equation (5)}$$

In an RGB signal determining processing (Step A6), the luminance value of each of R, G, B and W is calculated from the luminance values $R_2$, $G_2$, and $B_2$ and white color luminance value $W_{out}$ in a manner in which each of the luminance values is converted to be 1 or less by the following equation (6):

$$W_{out}=1$$

$$R_{out}=R_2-W_{out}=2-1=1$$

$$G_{out}=G_2-W_{out}=1.4-1=0.4$$

$$B_{out}=B_2-W_{out}=1-1=0 \qquad \text{Equation (6)}$$

In a reverse gamma conversion processing (Step A7), as shown in the following equation (7), the luminance values $R_{out}$, $G_{out}$, $B_{out}$ and $W_{out}$ are converted respectively into gray level values $R_{out}'$, $G_{out}'$, $B_{out}'$ and $W_{out}'$ (0, 1, . . . , 254, 255).

$$\begin{aligned} R'_{out} &= (\text{total gray level number}-1)\times R_{out}^{(1/\gamma)} \\ &= (256-1)\times 1^{(1/2.2)} = 255 \end{aligned} \qquad \text{Equation (7)}$$

$$\begin{aligned} G'_{out} &= (\text{total gray level number}-1)\times G_{out}^{(1/\gamma)} \\ &= (256-1)\times 0.4^{(1/2.2)} \approx 168 \end{aligned}$$

$$\begin{aligned} B'_{out} &= (\text{total gray level number}-1)\times B_{out}^{(1/\gamma)} \\ &= (256-1)\times 0^{(1/2.2)} = 0 \end{aligned}$$

$$\begin{aligned} W'_{out} &= (\text{total gray level number}-1)\times W_{out}^{(1/\gamma)} \\ &= (256-1)\times 1^{(1/2.2)} = 255 \end{aligned}$$

By the above processing, the RGBW video signal is generated from the RGB video signal.

Moreover, a liquid crystal display device described in Patent Reference 2 [Japanese Patent Application Laid-open No. 2006-317898 (Page 2, FIGS. 1 and 2) is provided with a liquid crystal panel having sub-pixels of four colors. A plurality of pieces of white data is extracted by a data converting section by using three source data inputted from outside and any one of a plurality of pieces of the white data extracted by a selecting signal fed from the outside is selected and three pieces of the source data are converted into four pieces of data. Four color data fed from the data converting section is supplied by a timing controller to a data driver and a gate driver and the data driver are controlled and a scan pulse is supplied by the data driver to each of the above sub-pixels and, at the same time, a video data signal is fed to each of the above sub-pixels.

In the data converting section, a reverse gamma correction is made by a reverse gamma correcting section to three color source data to generate three color corrected data and the maximum and minimum luminance values are detected by a luminance detecting section using the three color corrected data. A plurality of white signals is generated by a minimum value calculating section by using the minimum luminance value and the minimum luminance value and any one of a plurality of white signals is selected by a white color selecting section according to a selecting signal. A multiplying section multiplies white data by each constant of a weighing factor of each of the R, G, and B colors, resulting in the production of compensation white data and also multiplies the generated compensation white data by the three color corrected data, thus resulting in the production of primary three color data. A dividing section divides the primary three color data by the maximum luminance value, thus resulting in the production of secondary three color data and the color correcting section generates the primary four color data by using the compensation white data, three color corrected data, and secondary three color data. The gamma converting section makes a gamma correction to the primary four color data to finally generate four color data and supplies the four color data to the timing controller.

Moreover, in a liquid crystal display device described in Patent Reference 3 [Japanese Patent Application Laid-open No. 2007-041595 (Abstract, FIGS. 1 and 2)], a given RGB video signal is converted into an RGBW video signal via a signal converting section and rendering processing is performed thereon. After that, the processed RGBW video signal is stored, on a temporary basis, in a buffer section and also the RGBW video signal fed from the buffer section is supplied to a liquid crystal panel.

However, the devices described above have the following problems. That is, in the display device disclosed in the Patent Reference 1, when all of the three color of RGB are inputted with gray levels, if the minimum luminance value $M_2$ becomes 0.5 or less, a gray level value of the color corresponding to the minimum luminance value $M_2$, out of the colors RGB becomes 0 (in the above operation example, gray level value $B_{out}'$ is 0), displaying is performed at gray levels R, G, and B (in the above operation example, gray level values $R_{out}'$ and $G_{out}'$) R and G, except the white color and the minimum luminance value $M_2$. On the other hand, from a time point when the minimum luminance value M2 exceeds 0.5, the gray level value of the white subpixel reaches 255 being an upper limit, displaying is performed by using gray level values of RGB corresponding to the minimum luminance value M2 with the gray level value of the white subpixel being fixed to be 255. Thus, in the display device, with the minimum luminance M2 (=0.5) being used as a border, two kinds of behavior occurs, one being the case where white is displayed by the white subpixels only and another being the case where white is displayed by the RGB subpixels with the gray level being fixed to be W=255.

On the other hand, in the case where the display device is made up of a liquid crystal panel, in many cases, each of the R subpixel, G subpixel, and B subpixel is constructed of a pigment for a color filter, however, a white subpixel is not constructed of the pigment, but of an overcoat material to remove concave and convex portions that may occur between the R, G, and B subpixels and the white subpixel. This causes a difference in spectral characteristics among white pixels, resulting in the phenomenon in which chromaticity coordinates of each white differ in a chromaticity diagram. In this case, for example, as shown in FIG. 14, there is a difference between chromaticity coordinates (Δ) of white produced by three subpixels of R, G, and B and chromaticity coordinates (◇) of white produced by the white subpixel, thus resulting in the appearance of an inflection point at each line of demarcation among colors in a chromaticity diagram in the RGBW four color colorimetric system. Also, as shown in FIG. 15, in some cases, an inflection point appears in the characteristic of gray level versus luminance occurring when cyan is changed to be white by two color mixing of cyan and red. Thus, a problem occurs that, due to the inflection point in each characteristic, a singular point (for example, gamma characteristic abnormality or a like) appears on a display screen.

In addition, in the liquid crystal display device described in the Patent Reference 2, three color source data is converted by data converting section into four data, however, its configurations are different from the present invention.

In the liquid crystal display device described in the Patent Reference 3, an RGB video signal is converted into an RGBW video signal by a signal conversion section, however, its configurations are different from the present invention.

SUMMARY OF THE INVENTION

In view of the above, it is an object of the present invention to provide an image display device capable of preventing lowering of an image quality caused by the appearance of a singular point (gamma characteristic abnormality of display gray level or a like) on a display screen when an RGBW video signal is generated from an RGB vide signal, an image display method to be used in the image display device, such as a liquid crystal display device.

According to a first aspect of the present invention, there is provided an image display device including a display panel having a plurality of pixels, each pixel made up of a plurality of basic color subpixels each displaying each of a plurality of basic colors corresponding to a separated color for displaying a white color by additive mixture and a white subpixel to display a white color and a gray level signal converting unit to convert, when a basic color gray level signal being able to correspond to all of the basic colors is simultaneously inputted to any of the pixels, the basic color gray level signal into a converted gray level signal obtained by adding a white color and a driving unit to supply a corresponding subpixel gray level signal to each of the basic color subpixels and the white subpixel when said converted gray level signal is inputted from the gray level signal converting unit.

According to a second aspect of the present invention, there is provided an image display method to be employed by an image display device formed of a display panel having a plurality of pixels each being made up of a plurality of basic color subpixels displaying each of basic colors corresponding to separated colors of displaying a white color by color mixture and a white subpixel displaying a white color, the method including gray level signal converting processing of converting, when a basic color gray level signal corresponding to all of the basic colors is simultaneously inputted to any of the pixels, the basic color gray level signal into a converted gray level signal obtained by adding a white color and of simultaneously outputting the converted signal and driving processing of supplying a corresponding subpixel gray level signal, when the converted gray level signal is inputted from gray level converting unit, to each of the basic color subpixels and the white subpixel.

With the above configuration, when all of the basic color gray signals are inputted to the gray level signal converting section, all converted gray level signals are outputted. Therefore, even when there is a difference between chromaticity coordinates of white produced by the basic color subpixels and chromaticity coordinates of white produced singly by the white subpixel, no inflection point appears on a border line among colors in the chromaticity diagram in the multicolor colorimetric system and no inflection phenomenon occurs even in the gray level versus luminance characteristic obtained when one color is changed to be white by mixture of two colors with smooth change, thus enabling the improvement of a quality of a display screen.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EXEMPLARY EMBODIMENTS

Figure 1:
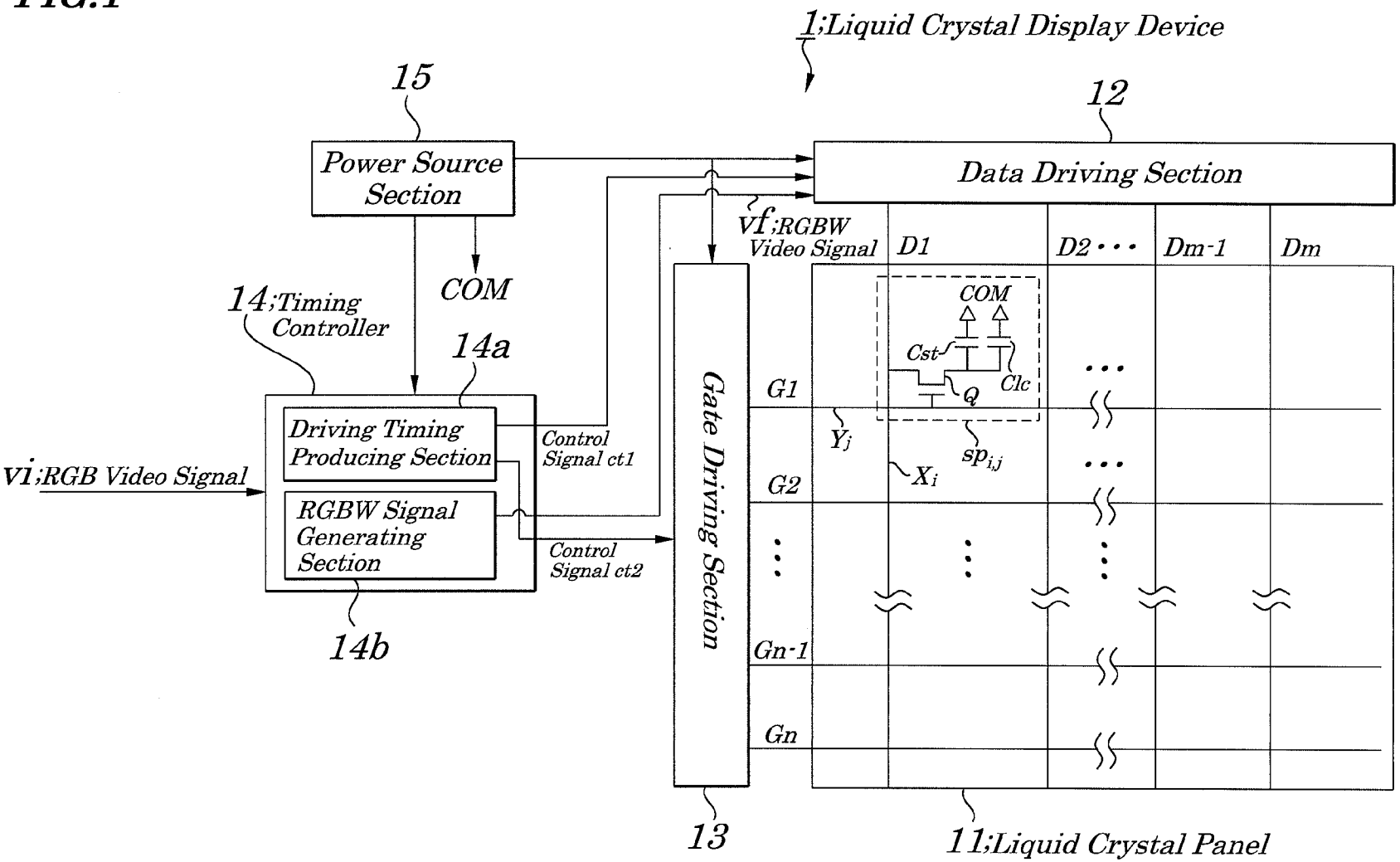
FIG. 1 is a block diagram showing electrical components of main portions of an image display device according to a first exemplary embodiment of the present invention.

Best modes of carrying out the present invention will be described in further detail using various exemplary embodiments with reference to the accompanying drawings.

A gray level signal converting unit of the present invention is so configured as to convert a gray level value for each of basic colors of a basic color gray level signal into each luminance value, to calculate a maximum luminance value and minimum luminance value from each luminance value, to calculate a first multicolor luminance value corresponding to a plurality of basic colors and a white color based on a first all white display luminance produced by a plurality of preset basic color subpixels, second all white display luminance produced by the white subpixel, each luminance value, and the minimum luminance value, to calculate a correction coefficient used to correct a first multicolor luminance value to make the first multicolor luminance value be a specified upper limit or less based on the first multicolor luminance value and the maximum luminance value, to calculate a second multicolor luminance value based on the first multicolor luminance value and the correction coefficient, to calculate second multicolor luminance value based on the first multicolor luminance value and the correction coefficient and to convert the second multicolor luminance into a gray level value to generate the converted gray level signal.

A display panel of the present invention has pixels each including three basic color subpixels to display three primary colors for obtaining white display by additive mixture of colors and the white subpixel and wherein the gray level signal converting unit is configured, as a four color gray level signal generating unit, to generate four color gray level signals corresponding to the three primary colors and white from a three color gray level signal corresponding to the inputted three primary colors and to transmit the generated signals to the driving unit and wherein the driving unit is so configured as to receive the four color gray level signal and to supply a corresponding subpixel gray level signal to each of the basic color subpixels and white subpixel and wherein the four color gray level signal generating unit is so configured as to perform gamma conversion on the three color gray level signal according to a gamma characteristic of the display panel and to convert three color gray level values corresponding to the three primary colors into three color luminance values and to calculate a maximum luminance value and minimum luminance value from the three color luminance values and to calculate first four color luminance values corresponding to the three primary colors and white color based on first all white display luminance produced by basic color subpixels corresponding to the three primary colors set in advance, second all white display luminance produced by the white subpixel, the three color luminance values, the minimum luminance value and to calculate a correction coefficient used to correct the first four color luminance values to make the value be a specified upper limit or less based on the first four color luminance values and the correction coefficient, to calculate second four color luminance value based on the first four color luminance value and the correction coefficient, and to perform reverse gamma conversion on the second four color luminance values to generate the four color gray level signal.

A four color gray level signal generating unit of the present invention includes a gamma converting unit to perform gamma conversion on the three color gray level signal to convert the three color gray level values into the three color luminance values, a maximum/minimum luminance value calculating unit to calculate the maximum luminance value and minimum luminance value from the three color luminance values outputted from the gamma converting unit, a first four color luminance value calculating unit to calculate the first four color luminance values based on the first all white display luminance, the second all white display luminance, the three color luminance values, the minimum luminance value, a correction coefficient calculating unit to calculate the correction coefficient based on the first four color luminance values and the maximum luminance value, a second four color luminance value calculating unit to calculate the second four color luminance values based on the first four color luminance values and the correction coefficient and a reverse gamma converting unit to perform reverse gamma conversion on the second four color luminance values to generate the four color gray level signal.

A correction coefficient calculating unit of the present invention is configured, when the maximum luminance value is greater than 0 (zero), to calculate a maximum value of the first four color luminance values/the maximum luminance value as the correction coefficient and, when the maximum luminance value is 0 (zero), to set the correction coefficient as 1 and wherein the second four color luminance value calculating unit is configured to calculate the first four color luminance values/the correction coefficient as the second four color luminance values and wherein a three primary color use luminance ratio is set in which a degree at which a gray level value of the three primary colors is used when the four color gray level signal is generated based on the three color gray level signal is represented as a ratio of a luminance value and wherein the correction coefficient calculating section, when the maximum luminance value is greater than 0 (zero), calculates the correction coefficient in a manner to be proportional to the three primary use luminance ratio.

A white subpixel use ratio upper limit value calculating section of the present invention is provided to calculate, based on the maximum luminance value and minimum luminance value calculated by the maximum/minimum luminance value generating unit, a ratio of the maximum luminance value to the minimum luminance value as an upper limit value of a ratio of using a white subpixel to be employed by the first four color luminance value calculating unit and wherein the first four color luminance value calculating unit calculates the first four color luminance values in a manner in which the minimum luminance value is made to be proportional to any ratio being the upper limit value or less, wherein the display panel has pixels each being made up of basic color subpixels of the primary colors in which a corresponding color layer is formed and the white subpixel in which no color layer is formed and wherein the display panel has a difference in chromaticity between a white color obtained by color mixture of basic color subpixels of the three primary colors and a white color obtained by the white subpixel.

First Exemplary Embodiment

FIG. 1 is a block diagram showing electrical components of main portions of an image display device of the first exemplary embodiment of the present invention. An example of the image display device of the first exemplary embodiment, as shown in FIG. 1, is a liquid crystal display device 1. The liquid crystal display device 1 includes a liquid crystal panel 11, a data driving section 12, a gate driving section 13, a timing controller 14, and a power source section 15. The liquid crystal panel 11 has signal lines Xi (i=1, 2, . . . , m; for example, m=1920), scanning lines Yj (j=1, 2, . . . , n; for example, n=1080) and subpixels SPi, j. To each of the signal lines Xi is supplied a voltage corresponding to a gray level pixel data Di (D1, D2, . . . , Dm−1, Dm) (subpixel gray level signal). To each of the scanning lines Yj is supplied a scanning signal Gj (G1, G2, . . . , Gn−1, Gn) in the order already set. Each of the subpixel SPi,j is mounted in an intersection portion of each of the signal lines Xi and each of the scanning lines Yj and is made up of a TFT (Thin Film Transistor) Q, a holding capacitor Cst, a liquid crystal layer C1*c*, a common electrode COM. The holding capacitor Cst holds a voltage corresponding to applied gray level pixel data Di. The liquid crystal layer C1*c* is a liquid crystal layer schematically displaying a pixel of a gray level corresponding to gray level pixel data Di. To the common electrode COM is applied a common voltage from the power source section 15. In the exemplary embodiment in particular, each pixel is made up of four subpixels SPi, j corresponding to three primary colors (RGB; basic color) producing a white color by additive mixture and a white (W) color.

The timing controller 14 has a driving timing producing section 14*a* and an RGBW signal generating section 14*b*. The driving timing producing section 14*a*, at the timing based on an RGB video signal "vi" (three color gray level signal), transmits a control signal "ct1" containing a polarity inversion signal generated according to a specified AC (Alternating Current) driving method (for example, dot inversion driving method) and a horizontal clock signal to the data driving section 12 and a control signal "ct2" to the gate driving section 13. Also, the RGBW signal generating section 14*b*, when a basic color gray level signal corresponding to all of the three primary colors (RGB) making up the RGB video signal "vi" is simultaneously inputted, converts the RGB video signal into a video signal "vf" (four color gray level signal, converted gray level signal) generated by adding W (white) to the basic color gray level signal and outputs the converted signals at the same time.

The data driving section 12 applies a voltage corresponding to gray level pixel data D1 based on the RGBW video signal "vf", for every subpixel SPi, j, in a manner to be in synchronization with a horizontal clock signal contained in the control signal "ct1" with the polarity based on a polarity inversion signal contained in the control signal "ct1", through each of the signal lines Xi. The gate driving section 13 applies a scanning signal Gj according to the control signal "ct2" generated by the driving timing producing section 14*a* in the timing controller 14 to each of the scanning lines Yj. The scanning signal Gj is outputted in a manner in which four kinds of subpixels SPi, j in total containing basic color subpixels of three colors (in the exemplary embodiment, R, G, and B) and white subpixel making up at least one unit pixel are simultaneously selected. The power source section 15 supplies predetermined power to each portion of the liquid crystal display device 1.

Figure 2:
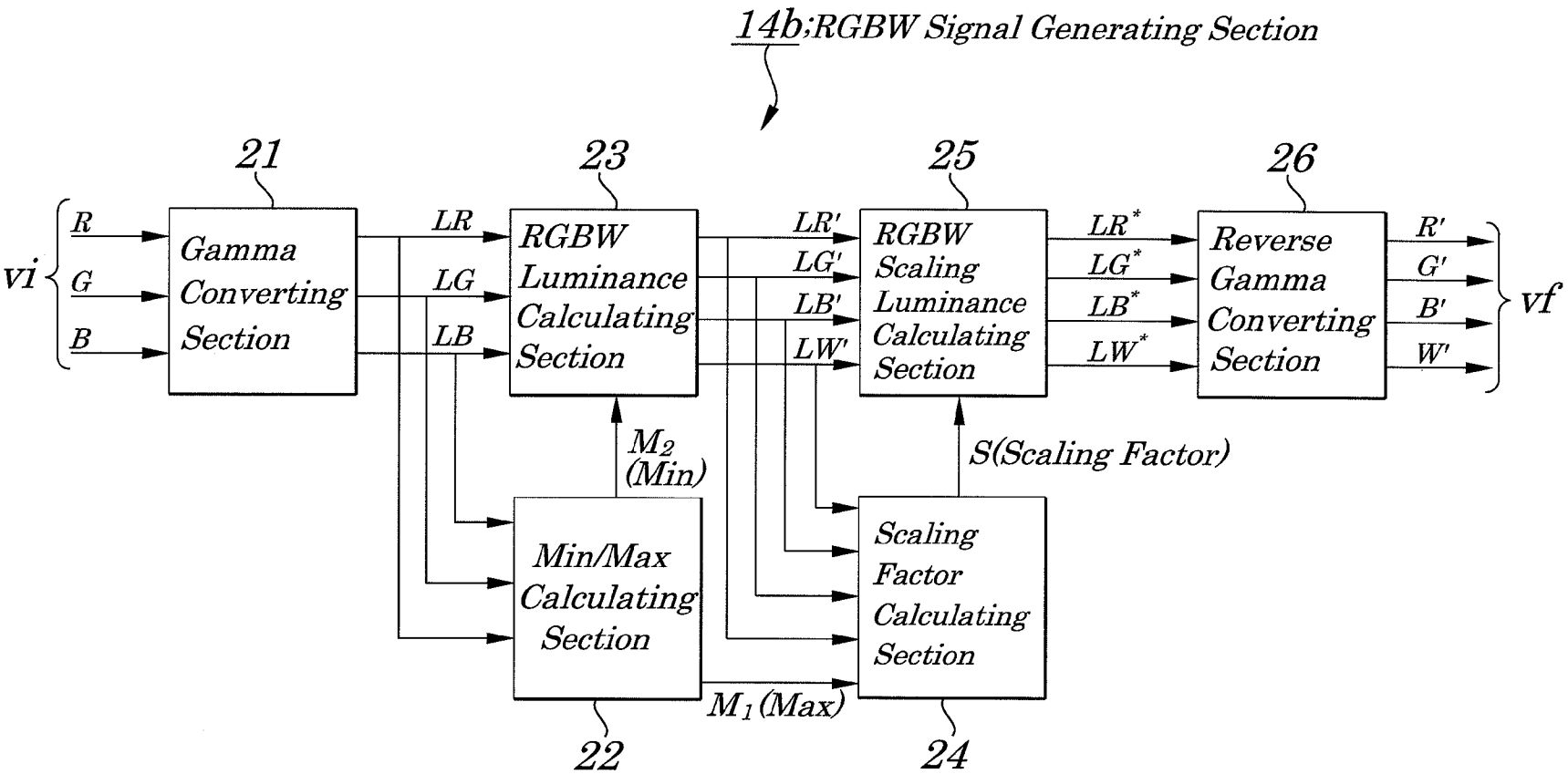
FIG. 2 is a block diagram showing electrical configurations of an RGBW signal generating section of FIG. 1.

FIG. 2 is a block diagram showing electrical configurations of the RGBW signal generating section 14*b* of FIG. 1. The RGBW signal generating section 14*b*, as shown in FIG. 2, includes a gamma converting section 21, a Min/Max calculating section 22, an RGBW luminance calculating section 23, a scaling factor calculating section 24, an RGBW scaling luminance calculating section 25, and a reverse gamma converting section 26. The gamma converting section 21 receives an RGB video signal "vi" and makes gamma correction to the RGB video signal "vi" according to gamma characteristics of the liquid crystal panel 11 and converts three color gray level values (RGB: gray level values) into three color luminance values LR, LG, and LB. The Min/Max calculates the maximum luminance value $M_1$ and minimum luminance value $M_2$ of the three color luminance values LR, LG, and LB based on three color luminance values LR, LG, and LB outputted from the gamma converting section 21. The RGBW luminance calculating section 23 calculates the first four color luminance values LR', LG', LB' and LW' corresponding to each of the basic colors and white color based on the first all white display luminance (also referred to as first full white display luminance) produced by the preset basic color subpixels, the second all white display luminance (also referred to as second full white display luminance) produced by the white subpixel, three color luminance values LR, LG, and LB, and minimum luminance value $M_2$.

The scaling factor calculating section 24 calculates, based on the first four color luminance values LR', LG', LB', and LW', and the maximum luminance values $M_1$, a scaling factor S (correcting factor) to be used for making a correction so that each of the first four color luminance values LR', LG', LB', and LW' becomes 1 (upper limit) or less. In the exemplary embodiment in particular, the scaling factor calculating section 24 calculates, when the maximum luminance value $M_1$ is greater than 0 (zero), the maximum value/maximum luminance value $M_1$ of the first four color luminance values LR', LG', LB' and LW' as the scaling factor S and sets, when the maximum luminance value $M_1$ is 0 (zero), the scaling factor S to be 1 (one).

The RGBW scaling luminance calculating section 25 calculates, based on the first four color luminance values LR', LG', LB', and LW' and the scaling factor S, the second four color luminance values LR*, LG*, LB*, and LW*. In the exemplary embodiment in particular, the RGBW scaling luminance calculating section 25 calculates the second four color luminance values (LR*, LG*, LB*, and LW*) by dividing the first four color luminance values LR', LG', LB' and LW' by the scaling factor S. The reverse gamma converting section 26 performs reverse gamma conversion on the second four color luminance values LR*, LG*, LB*, and LW* to generate the RGBW video signal "vf" corresponding to gray levels (R', G', B', and W') of four colors. Moreover, in the exemplary embodiment, the RGBW signal generating section 14*b* is made up of a one chip integrated circuit.

Figure 3:
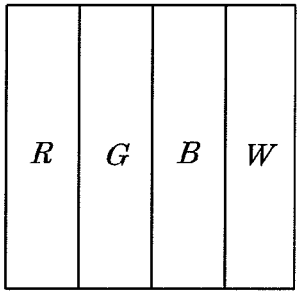
FIG. 3 is a diagram showing an example of an arrangement of four subpixels corresponding to three primary colors (R, G, and B) and a white (W) color making up one pixel of the liquid crystal panel of FIG. 1.
Figure 4:
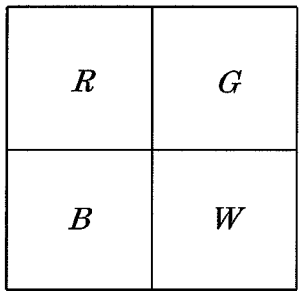
FIG. 4 is a diagram showing another example of the arrangement of the four subpixels.
Figure 5:
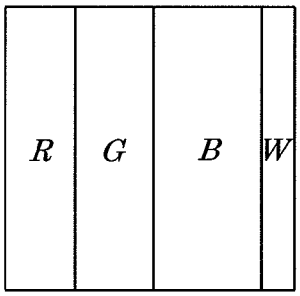
FIG. 5 is also a diagram showing another example of the arrangement of the four subpixels.
Figure 6:
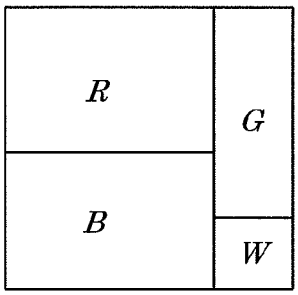
FIG. 6 is also a diagram showing another example of the arrangement of the four subpixels.

FIG. 3 is a diagram showing an example of an arrangement of four subpixels corresponding to three primary colors (R, G, and B) and a white (W) color making up one pixel of the liquid crystal panel 11 of FIG. 1. FIGS. 4, 5, and 6 are diagrams showing other examples of arrangements of four subpixels. As shown in FIG. 3, one pixel is configured to be arranged in a column direction so that subpixels for R, G, and B, and W have the same area ratio. In this case, the scanning signal G is line-sequentially outputted, for every line, from the gate driving section 13 so that subpixels for R, G, B, and W making up each pixel are simultaneously selected. Also, as shown in FIG. 4, the subpixels for R and G are arranged in a column direction so as to have the same area ratio and the subpixels for B and W are arranged in a column direction so as to have the same area ratio and the subpixels for R and B are arranged in a row direction and the subpixels for G and W are arranged in a row direction. In this case, the scanning signal Gj is line-sequentially outputted, for every two lines, from the gate driving section 13 so that the subpixels for R, G, B, and W are simultaneously selected.

As shown in FIG. 5, the subpixels for R, G, B, and W are arranged in a column direction so that the area of the subpixel for B is larger than that of the R and G subpixels and so that the area of the W subpixel is smaller than those of the R, G, and B subpixels. In this case, the scanning signal Gj is outputted line-sequentially, for every line, so that the subpixels for R, G, B, and W are simultaneously selected. Also, as shown in FIG. 6, the subpixels for R and G are arranged in a row so that the area of the R subpixel is smaller than that of the G subpixel and the subpixels for G and W are arranged in a row direction so that the area of the W subpixel is smaller than that of the B subpixel. Also, the R and B subpixels are arranged in a row direction so as to have the same area ratio and the G and W subpixels are arranged in a row direction so that the area of the W subpixel is smaller than that of the G subpixel. In this case, the scanning signal Gj is line-sequentially outputted, for every two lines, from the gate driving section 13 so that the R, G, B, W subpixels are simultaneously selected.

The above one pixel is made up of subpixels of three primary colors where each of corresponding color layers is formed and of the white subpixel where no color layer is formed.

That is, the three primary colors are produced by pigments of color filters, however, in the white subpixel, no pigment is used. In order to remove concave and convex portions between the subpixels of the three primary colors and the white subpixel, a transparent resin may be employed. Generally, a difference in spectral characteristics occurs between the subpixels of three colors and white subpixels. Therefore, the chromaticity coordinates of white obtained by the passage through the subpixels of three colors are different from the chromaticity coordinates obtained by the passage through the white subpixel.

Figure 7:
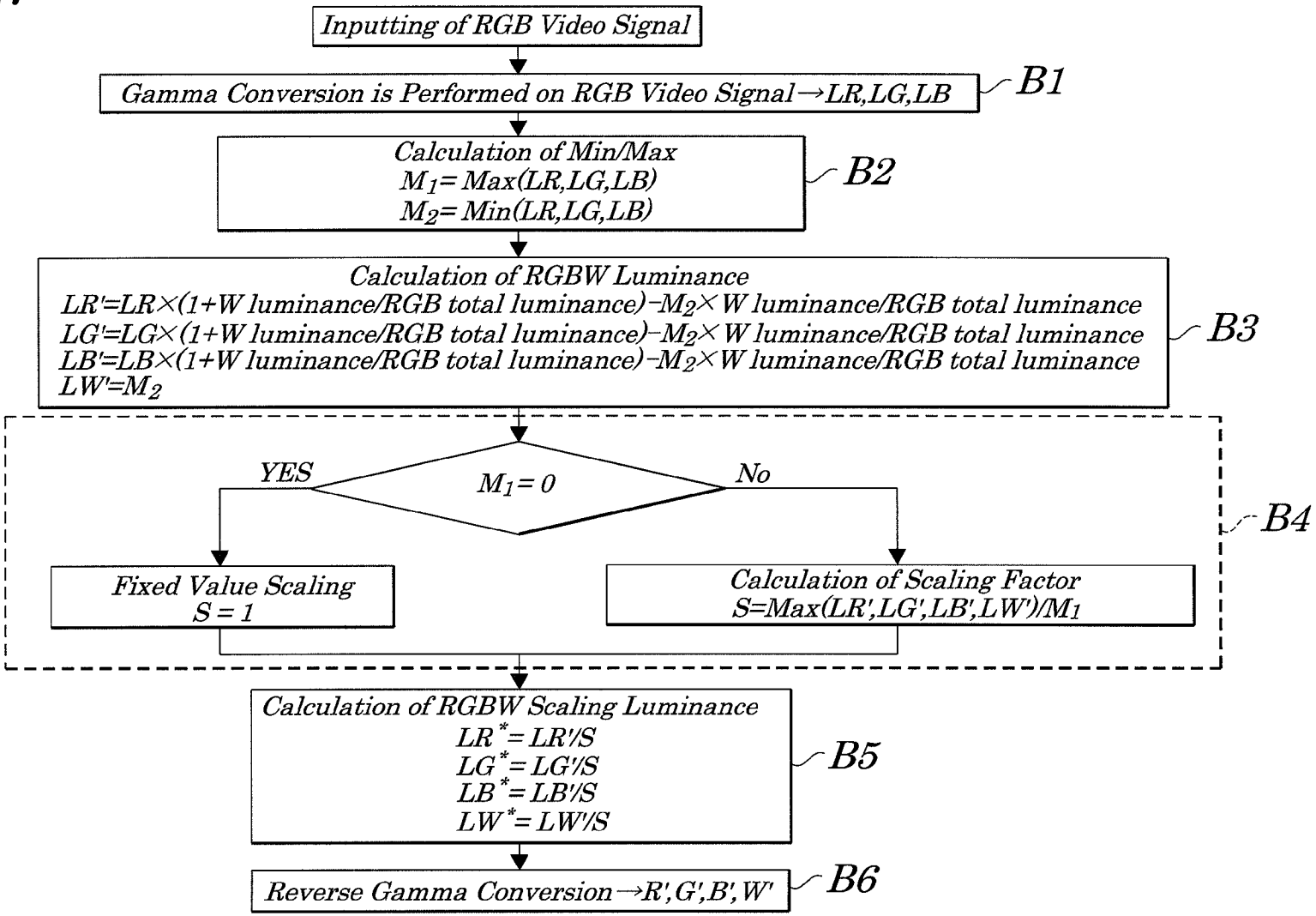
FIG. 7 is a flow chart explaining operations of the RGBW generating section of FIG. 2.
Figure 8:
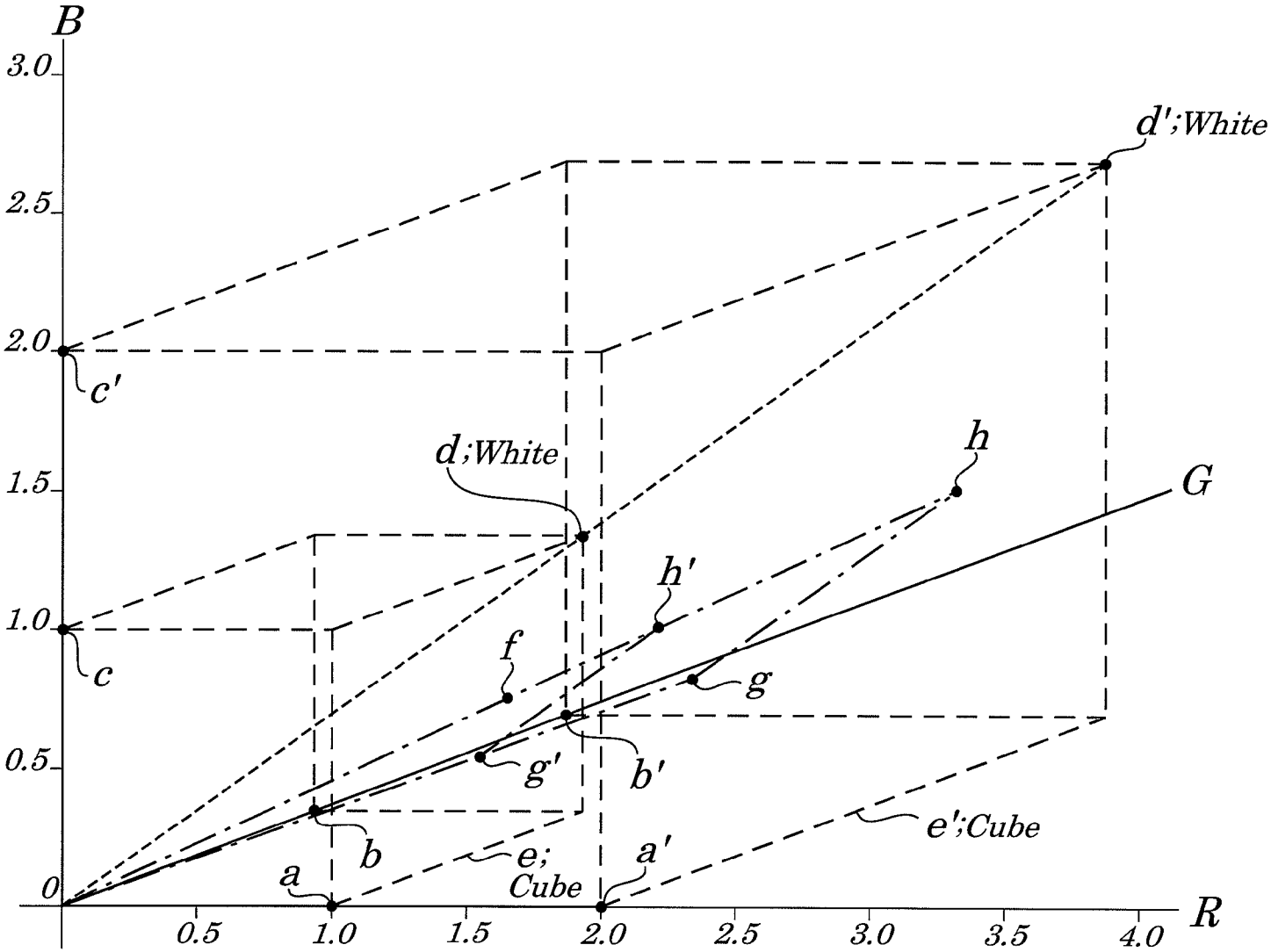
FIG. 8 is a vector diagram showing a relation between chromaticity and luminance obtained in operations of the RGBW signal generating section 14*b;*
Figure 9:
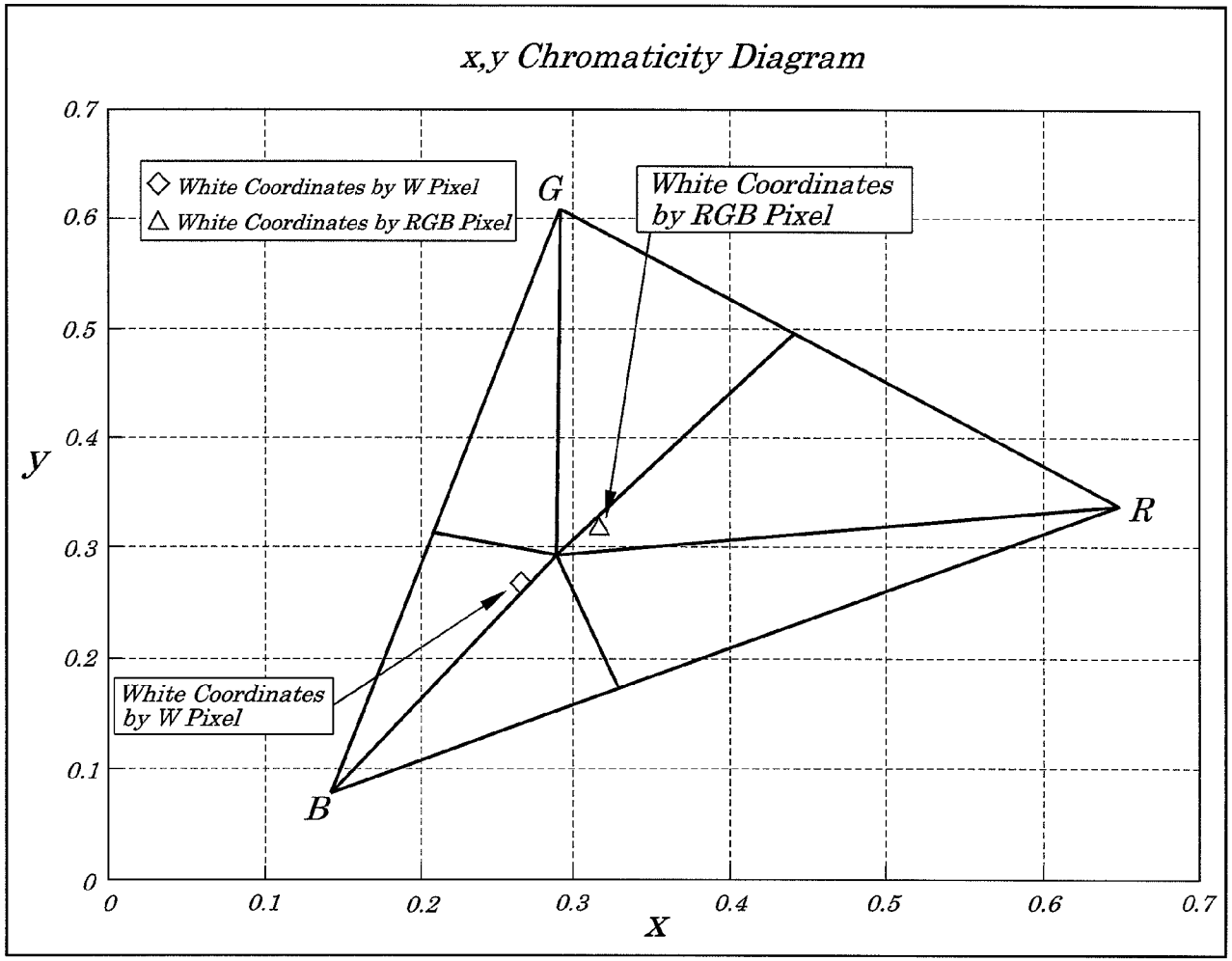
FIG. 9 is an x, y chromaticity diagram obtained in operations of the RGBW signal generating section.
Figure 10:
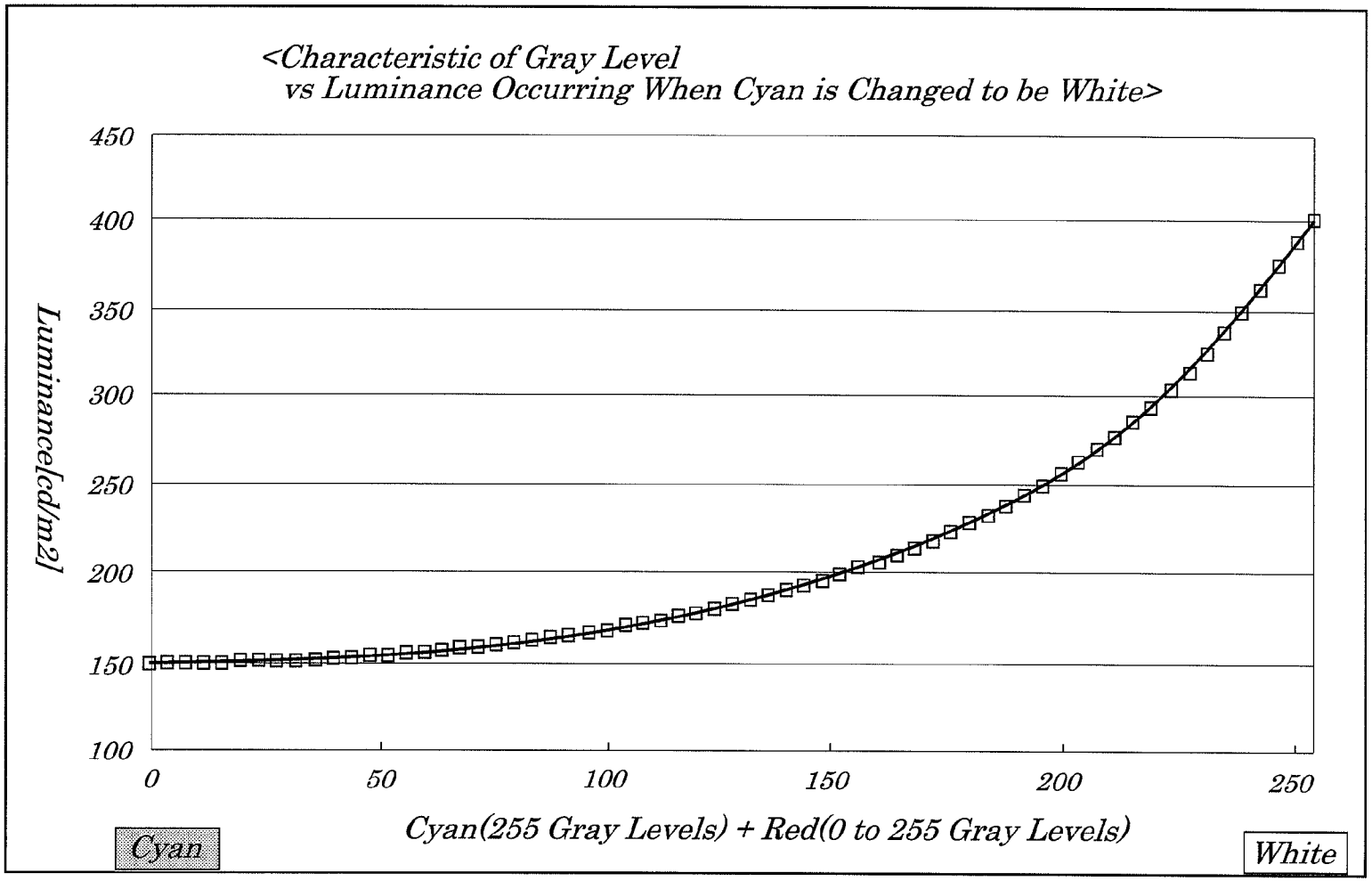
FIG. 10 is a diagram showing characteristics of chromaticity vs luminance occurring when cyan is changed to be white by the mixture of two colors of cyan and red.

FIG. 7 is a flow chart explaining operations of the RGBW signal generating section 14*b* of FIG. 2. FIG. 8 is a vector diagram showing a relation between chromaticity and luminance obtained in operations of the RGBW signal generating section 14*b*. FIG. 9 is an x, y chromaticity diagram in operations of the RGBW signal generating section 14*b*. FIG. 10 is a diagram showing characteristics of gray level versus luminance obtained when cyan is changed to be white by the mixture of two colors of cyan and red. By referring to these drawings, processing in the image display method employed in the liquid crystal display device of the exemplary embodiment is described.

According to the exemplary embodiment of the present invention, each of R, G, and B making up the RGB video signal "vi" is made up of 8 bit data width (gray level values are 0, 1, . . . , 254, 255) and each of the gray level values is 255 for R, 217 for G, and 186 for B and each gamma (γ) is 2.2. When white is displayed only by subpixels of basic colors of R, G, and B, white luminance (first all white display luminance) is set to be 200 cd/$m^2$ and, when white is displayed only by the subpixel of white, white luminance (second all white display luminance) is set to be 200 cd/$m^2$ and the white luminance ratio is 1:1.

In FIG. 8, a length of a vector from a point of origin represents a luminance value of R, G, and B components and a direction from the point of origin represents chromaticity and, in the case where a calorimetric system is made up of three colors of R, G, and B, a cube "e" surrounded by a point "a" (R=1), a point "b" (G=1), and a point "c" (B=1) is a displayable region. Moreover, the cube "e'" is obtained by doubling each of the luminance values of R, G, and B making up the cube "e". The white (white color displayed only by subpixels of basic colors of R, G, and B) of the cube "e" is shown at the point "d" and the white (white color obtained by doubling the luminance at the point "d") of the cube "e'" is shown at the point "d'". In the exemplary embodiment, it is presumed that the chromaticity of the white (at the point "d") displayed only by the subpixels of R, G, and B is the same as the chromaticity of white displayed by the white subpixel.

In the liquid crystal display device of the present invention, the RGBW video signal "vf" is generated by the RGBW signal generating section 14*b* based on the inputted RGB video signal "vi" and is transmitted to the data driving section 12 (four color gray level signal generating processing). That is, the RGB video signal "vi" is inputted to the gamma converting section 21 and the gamma conversion is performed on the RGB video signal "vi" according to gamma characteristics of the liquid crystal panel 11 and gray level values of R, G, and B (three color gray level values) are converted into the three color luminance values LR, LG, and LB by the following formula (11) (Step B1, gamma converting processing).

$$LR=[R/(\text{total gray level number}-1)]^{\gamma}=[255/(256-1)]^{2.2}=1$$

$$LG=[G/(\text{total gray level number}-1)]^{\gamma}=[217/(256-1)]^{2.2}\approx 0.7$$

$$LB=[B/(\text{total gray level number}-1)]^{\gamma}=[186/(256-1)]^{2.2}\approx 0.5 \qquad \text{Equation (8)}$$

The luminance and chromaticity obtained when R, G, and B are mixed in a manner to correspond to these luminance values LR, LG, and LB are displayed at the point "f" in FIG. 8.

The maximum luminance value $M_1$ and minimum luminance value $M_2$ of the three color luminance values LR, LG, and LB outputted from the gamma converting section 21 are calculated by the Min/Max calculating section 22 according to the following equations (12) and (13) (Step B2, maximum/minimum luminance value calculating processing).

$$M_1=\text{Max}(LR,LG,LB)=1 \qquad \text{Equation (9)}$$

$$M_2=\text{Min}(LR,LG,LB)=0.5 \qquad \text{Equation (10)}$$

The first four color luminance values LR', LG', LB', and LW' in the region where luminance is expanded by the addition of the white subpixel are calculated based on the first all white display luminance, second all white display luminance, three color luminance values LR, LG, and LB, and the minimum luminance value $M_2$ by the following Equation (11) (Step B3, first four color luminance value calculating processing).

L=all white display luminance produced by white subpixel/all white display luminance produced by basic color subpixels of R, G, and B=200/200=1

$$LR'=LR\times(1+L)-M_2\times L=1\times(1+1)-0.5\times 1=1.5$$

$$LG'=LG\times(1+L)-M_2\times L=0.7\times(1+1)-0.5\times 1=0.9$$

$$LB'=LB\times(1+L)-M_2\times L=0.5\times(1+1)-0.5\times 1=0.5$$

$$LW'=M_2=0.5 \qquad \text{Equation (11)}$$

The luminance and chromaticity obtained when R, G, and B are mixed in a manner to correspond to these luminance values LR', LG', and LB' are displayed at the point "g" in FIG. 8 and the luminance and chromaticity obtained when R, G, B, and W are mixed in a manner to correspond to these luminance values LR', LG', LB', and LW' are displayed at the point "h" in FIG. 8. The point "h" is located on a vector line in the same direction as for the point "f" obtained when R, G, and B are mixed in a manner to correspond to the luminance values LR, LG, and LB and, therefore, it is understood that the luminance is increased at the same chromaticity.

Next, if the luminance value calculated by the Equation (11) exceeds 1 (upper limit), a value that does not exist appears when the luminance values (0 to 1) is converted into gray level values (0 to 255) and, therefore, processing is performed so that the luminance value is 1 or less. That is, a scaling factor S used to make a correction so that each of the first four color luminance values LR', LG', LB', and LW' is 1 or less is calculated by the scaling factor calculating section 24 based on the first four color luminance values LR', LG', LB', and LW' and the maximum luminance value $M_1$ (Step B4, correction coefficient calculating processing). In the correction coefficient calculating processing, when the maximum luminance value $M_1$ is greater than 0, the value to be obtained by diving the maximum value of the first four luminance values LR', LG', LB', and LW' by the maximum luminance value $M_1$ is calculated as the scaling factor S by the following Equation (12):

$$S=\text{Max}(LR',LG',LB',\text{ and } LW')/M_1=1.5/1=1.5 \text{ (however, when } M_1=0,\ S=\text{fixed value scaling of 1)} \qquad \text{Equation (12)}$$

The second four color luminance values LR*, LG*, LB*, and LW* are calculated by the RGBW scaling luminance calculating section 25 based on the first four color luminance values LR', LG', LB', and LW' and on the scaling factor S so that each of luminance values of R, G, and B becomes 1 or less (Step B5, second four color luminance value calculating processing). In the second four color luminance value calculating processing, each of the second four color luminance values LR*, LG*, LB*, and LW* is calculated by dividing the first four color luminance values LR', LG', LB', and LW' by the scaling factor S according to the following Equation (13):

$$LR^*=LR'/S=1.5/1.5=1$$

$$LG^*=LG'/S=0.9/1.5=0.6$$

$$LB^*=LB'/S=0.5/1.5\approx 0.333$$

$$LW^*=LW'/S=0.5/1.5\approx 0.333 \qquad \text{Equation (13)}$$

The luminance and chromaticity obtained by mixing the R, G, and B colors in a manner to correspond to the above luminance values LR*, LG*, and LB* are shown at the point "g" in FIG. 8 and the luminance and chromaticity obtained by mixing the R, G, B and W colors in a manner to correspond to the above luminance values LR*, LG*, LB*, and LW* are shown at the point "h". The point "h" is located on a vector line in the same direction as for the point "f" obtained by mixing colors in a manner to correspond to the luminance values and, therefore, it is understood that the luminance is increased at the same chromaticity.

The reverse gamma conversion is performed by the reverse gamma converting section 26 on the second four color luminance values LR*, LG*, LB*, and LW* according to the following Equation (14) and the RGBW video signal "vf" corresponding to the four color gray level values (R', G', B', and W'; gray level values 0 to 255) is generated (Step B6, reverse gamma converting processing).

$$\begin{aligned} R' &= (\text{total gray level number}-1)\times LR^{*(1/2.2)} \\ &= (256-1)\times 1^{(1/2\cdot 2)}=255 \\ G' &= (\text{total gray level number}-1)\times LG^{*(1/2.2)} \\ &= (256-1)\times 0.6^{(1/2\cdot 2)}\approx 202 \\ B' &= (\text{total gray level number}-1)\times LB^{*(1/2.2)} \\ &= (256-1)\times 0.333^{(1/2\cdot 2)}\approx 155 \\ W' &= (\text{total gray level number}-1)\times LW^{*(1/2.2)} \\ &= (256-1)\times 0.333^{(1/2\cdot 2)}\approx 155 \end{aligned} \qquad \text{Equation (14)}$$

In the exemplary embodiment, it is presumed that the chromaticity of white (point "d" in FIG. 8) produced by the basic color subpixels of R, G, and B is the same as that of white produced by the white subpixel. However, as described above, in general, there is a difference in spectral characteristics between the subpixels of three primary colors and white subpixel. As a result, as shown in FIG. 9, the chromaticity coordinates (Δ) of white produced by the subpixels of three primary colors of R, G, and B are different from the chromaticity coordinates (◇) of white produced by the white subpixel. According to the exemplary embodiment, even when there is a difference in both white coordinates, though such a state is not ideal, the appearance of an inflection point on a border line can be avoided among colors in chromaticity diagram in the RGBW four color calorimetric system.

Also, as shown in FIG. 10, in the gray level versus luminance characteristics occurring when cyan is changed to be white by mixture of cyan and red or when a color is changed to be white by mixture of other two colors, no inflection point appears with a smooth change from cyan to white, thus improving the quality of a display screen. That is, no inflection phenomenon occurs in each of characteristics and, therefore, no singular point (for example, gamma characteristic abnormality of displaying gray levels) appears, thus resulting in the improvement of a display screen.

As described above, according to the first exemplary embodiment, the RGB video signal "vi" is converted by the gamma converting section 21 into three color luminance values LR, LG, and LB. Then, the maximum luminance value $M_1$ and minimum luminance value $M_2$ of the three color luminance values LR, LG, and LB are calculated by the Min/Max calculating section 22. The first four color luminance values LR', LG', LB', and LW' are calculated by the RGBW luminance calculating section 23. The scaling factor S is calculated by the scaling factor calculating section 24 based on the first four color luminance values LR', LG', LB', and LW'.

The second four color luminance values LR*, LG*, LB*, and LW* are calculated by the RGBW scaling luminance calculating section 25 based on the first four color luminance values LR', LG', LB' and LW' and on the scaling factor S. The RGBW video signal "vf" corresponding to four gray level values is generated by the reverse gamma converting section 26. Thus, when all three colors of R, G, and B are inputted with gray levels, the gray level display is always performed by using four subpixels of R, G, B, and W. Owing to this, even when chromaticity coordinates of white produced by basic color subpixels of R, G, and B are different from the chromaticity coordinates of white produced by the white subpixel only, no inflection point appears on the border among colors in the chromaticity diagram of the RGBW four color calorimetric system and no inflection phenomenon occurs in the gray level versus luminance characteristics when one color is changed to be white by the mixture of two colors with a smooth change between the two colors. Moreover, owing to the white subpixel, as shown at the point "h" in FIG. 8, luminance is increased.

Second Exemplary Embodiment

Figure 11:
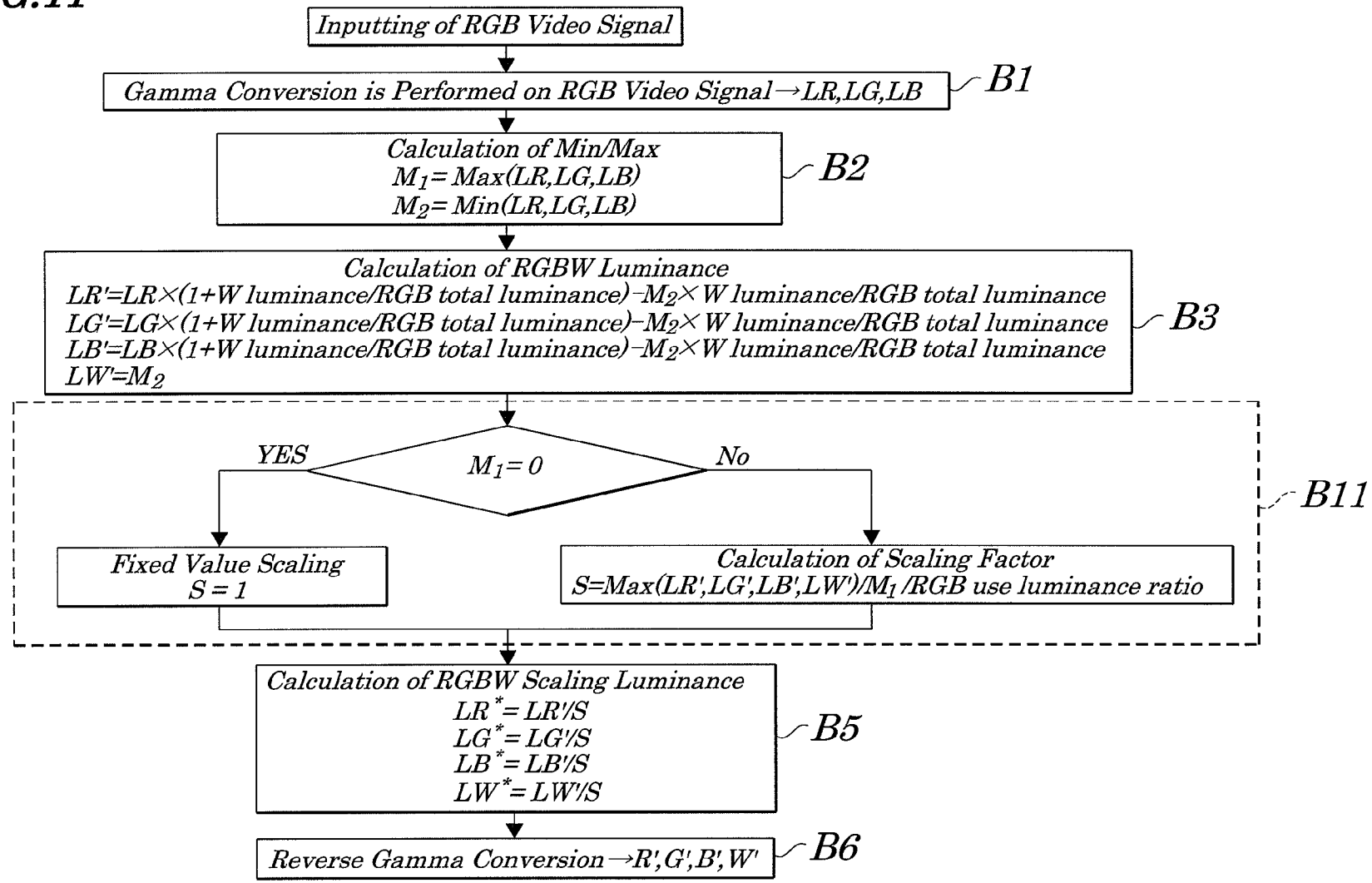
FIG. 11 is a flow chart explaining operations of the liquid crystal display device according to a second exemplary embodiment of the present invention.

FIG. 11 is a flow chart explaining other operations of the liquid crystal display device of the second exemplary embodiment of the present invention. In FIG. 11, the same reference is assigned to elements having the same functions as in the first exemplary embodiment in FIG. 7. According to the second exemplary embodiment, in an RGBW signal generating section 14*b*, an RGB use luminance ratio (three primary color use luminance ratio) is set in which the degree at which gray level values of R, G, and B are used when an RGBW video signal "vf" is generated based on an RGB video signal "vi" is represented as a ratio of a luminance value. The RGB use luminance ratio, when a luminance value is 1 when each of R, G, and B colors is inputted at gray level 255 and when 50% of a gray level value is used, becomes 0.5. Then, a scaling factor calculating section 24 in FIG. 2, when a maximum luminance value $M_1$ is greater than 0, calculates a scaling factor S in a manner to be proportional to the above use luminance ratio.

In the liquid crystal display device of the present invention, as shown in FIG. 11, when the maximum luminance value $M_1$ is greater than 0, the scaling factor S is calculated in a manner to be proportional to an RGB use luminance ratio (Step B11, correction coefficient calculating processing). Therefore, even when R, G, and B in the region of luminance and chromaticity (corresponding to cubes e and e' in FIG. 8) occurring when a white subpixel is added is 1 or less, as in the case of the first exemplary embodiment, the RGBW video signal "vf" is generated.

Third Exemplary Embodiment

Figure 12:
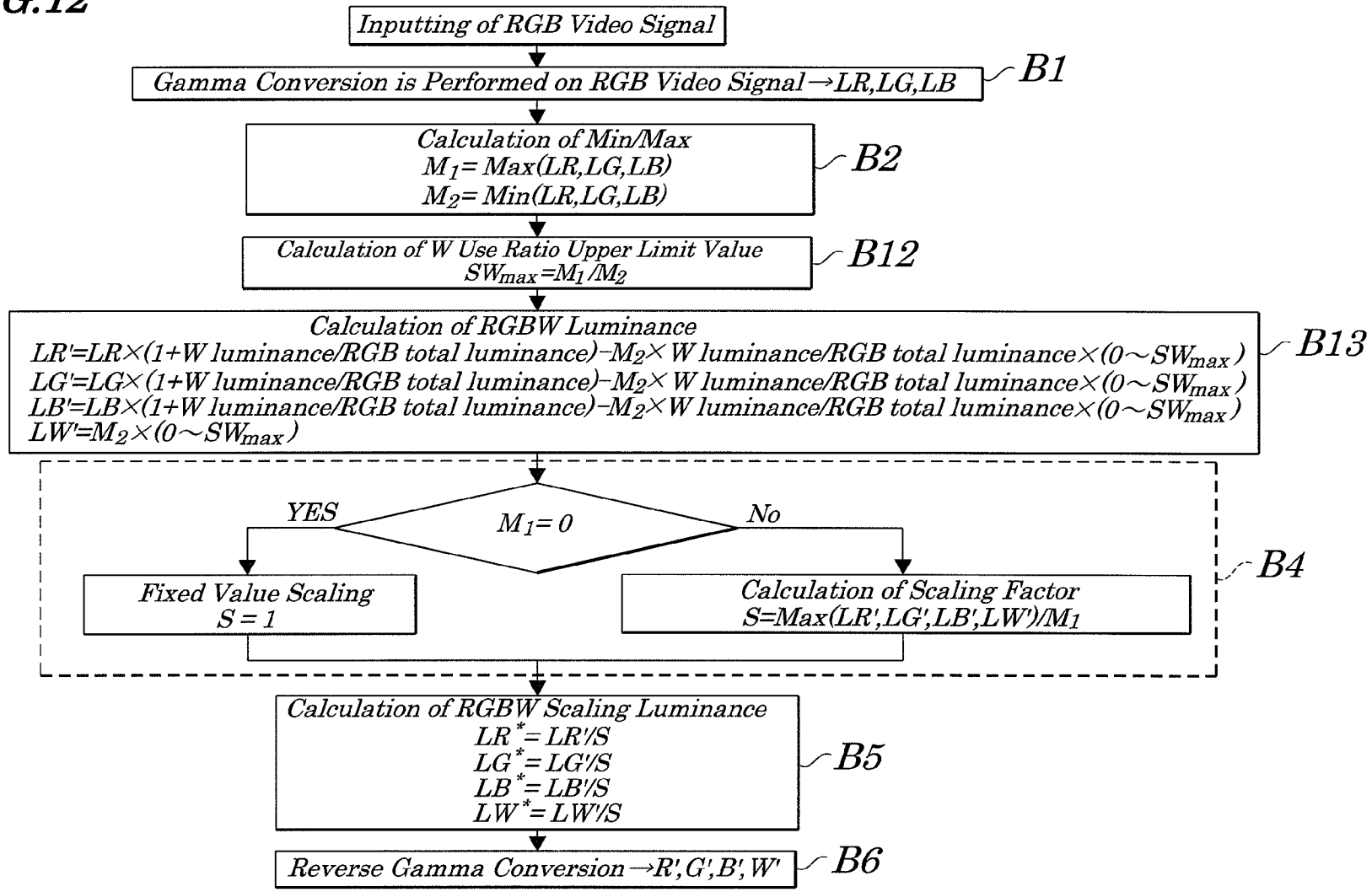
FIG. 12 is also a flow chart explaining operations of the liquid crystal display device according to a third exemplary embodiment of the present invention.
Figure 13:
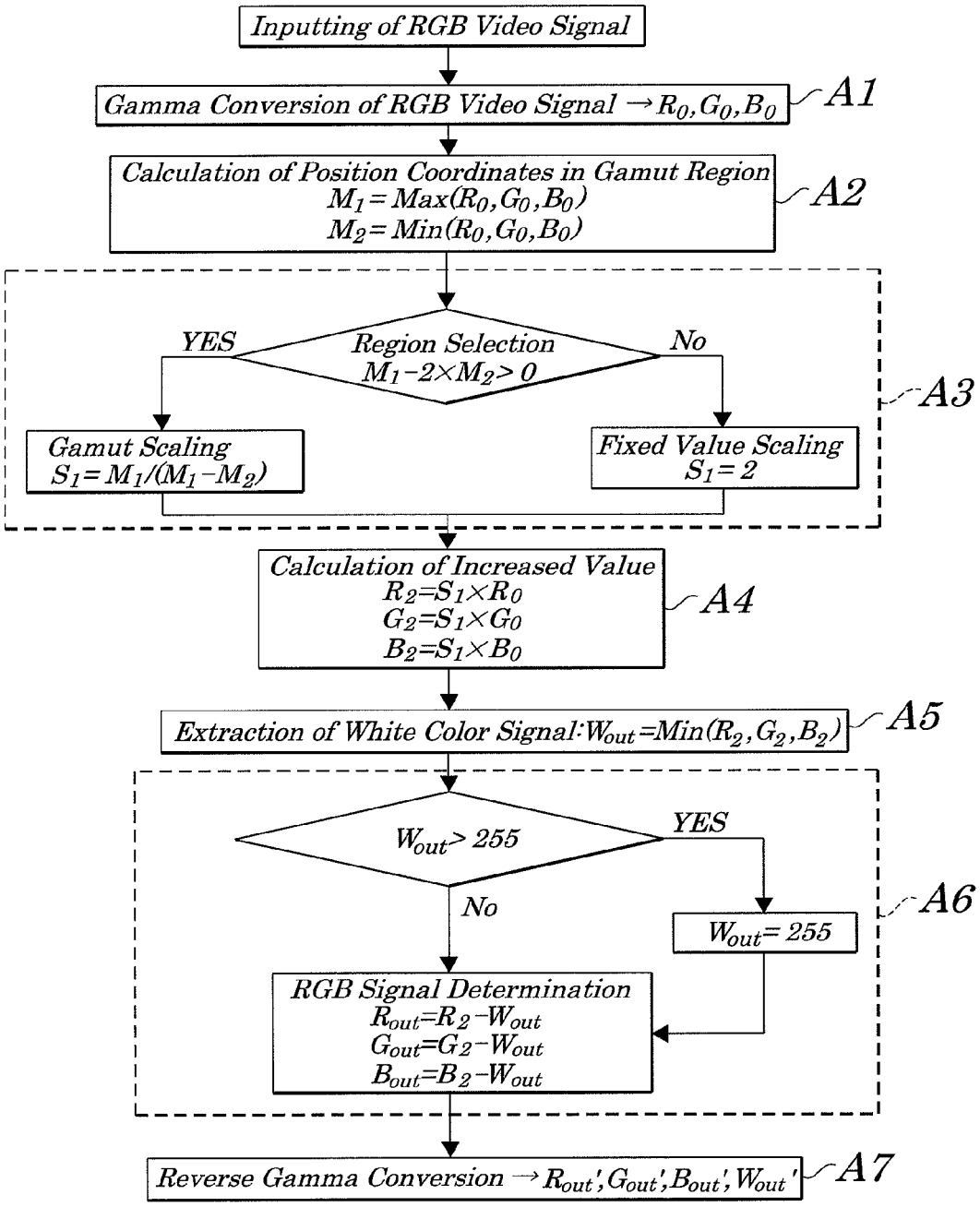
FIG. 13 (RELATED ART)
FIG. 13 is a flow chart explaining operations of a related image display device.
Figure 14:
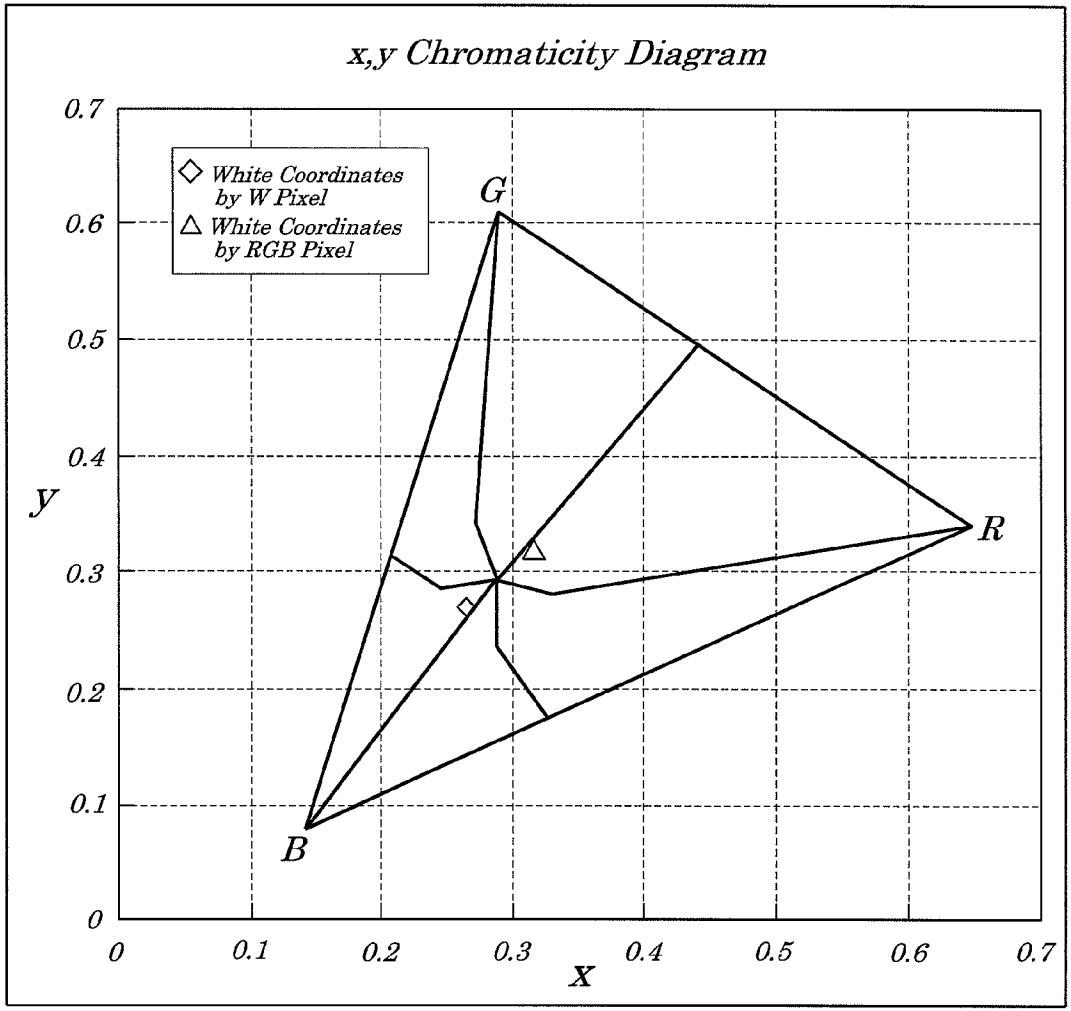
FIG.14 (RELATED ART)
FIG. 14 is an x, y chromaticity diagram obtained in operations of the related image display device.
Figure 15:
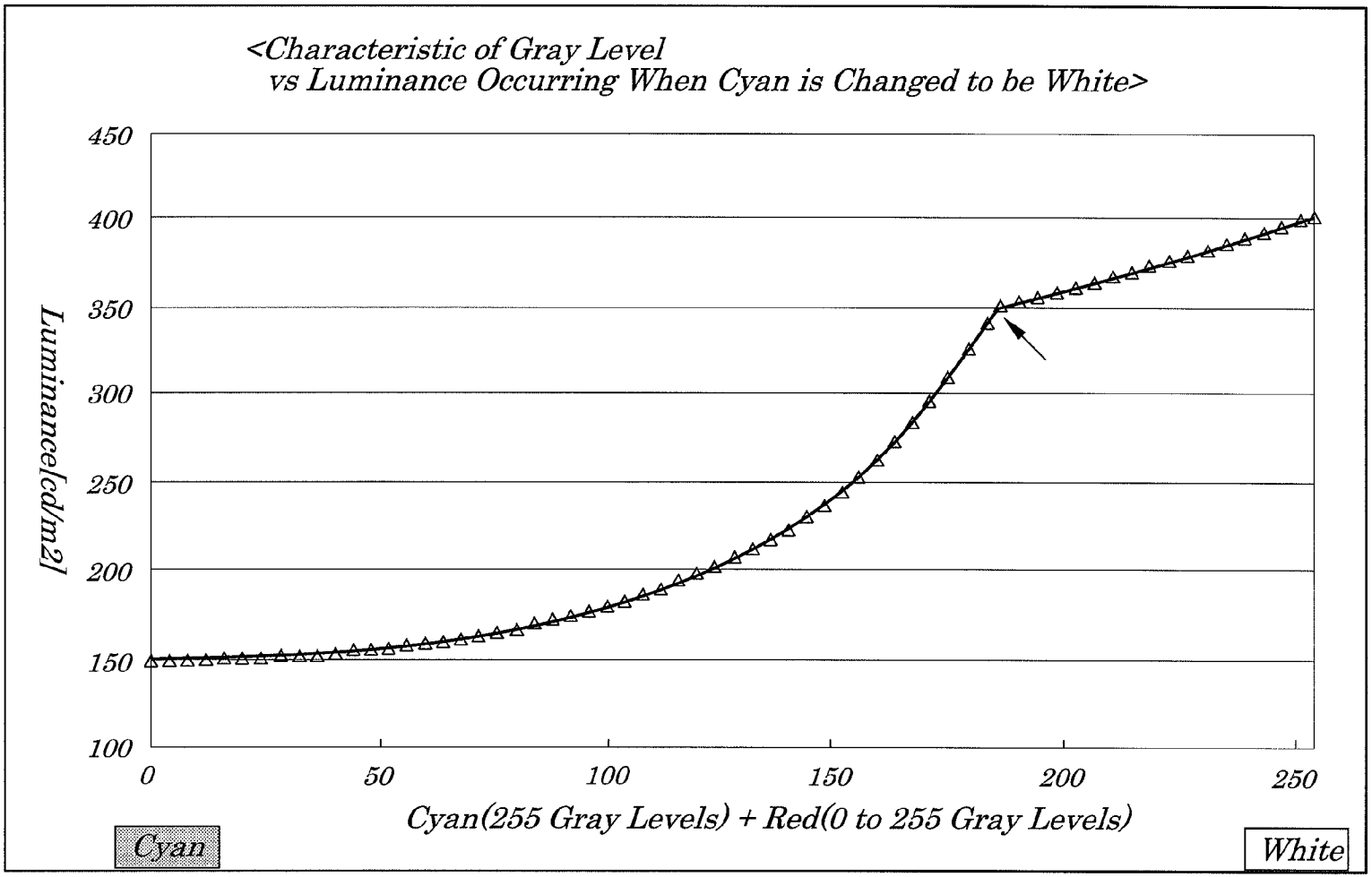
FIG. 15 (RELATED ART)
FIG. 15 is a diagram showing characteristics of chromaticity vs luminance occurring when cyan is changed to be white by the mixture of two colors of cyan and red in operations of the related image display device.

FIG. 12 is a flow chart explaining other operations of a liquid crystal display device of the third exemplary embodiment of the present invention. The liquid crystal display device has a white subpixel use ratio upper limit value calculating section in which a ratio of a maximum luminance value $M_1$ to a minimum luminance value $M_2$ is calculated, based on the maximum luminance value $M_1$ and the minimum luminance value $M_2$, as an upper value of a ratio of using a white subpixel in an RGBW luminance calculating section 23. Then, the RGBW luminance calculating section 23 in FIG. 2 calculates first four color luminance values LR', LG', LB', and LW' in a manner in which the minimum luminance value $M_2$ is proportional to any ratio being smaller than the above upper limit value.

In the liquid crystal display device of the third exemplary embodiment, as shown in FIG. 12, a ratio ($M_1/M_2$) of the maximum luminance value $M_1$ to the minimum luminance value $M_2$ is calculated as the upper limit $SW_{max}$ of the ratio of using the white (W) pixel in the first four color luminance value calculating processing (Step B12, white subpixel use ratio upper limit value calculating processing). In the four color luminance value calculating processing (Step B13), the first four color luminance values LR', LG', LB', and LW' are calculated in a manner in which the minimum luminance value $M_2$ is proportional to any ratio being smaller than the upper limit value $SW_{max}$. This enables the ratio of using a white pixel to be changed arbitrarily.

While the invention has been particularly shown and described with reference to exemplary embodiments thereof, the invention is not limited to these exemplary embodiments. It will be understood by those of ordinary skill in the art that various changes in form and details may be made therein without departing from the spirit and scope of the present invention as defined by the claims. For example, the three primary colors are not limited to R, G, and B, and Y (yellow), C (cyan), and M (magenta) may be used which can provide almost the same actions and effects of the invention as the above exemplary embodiments. The configurations of the subpixels of RGBW shown in FIGS. 3, 4, 5, and 6 are not limited to those shown in these drawings and the arrangements of the subpixels may be changed according to required luminance and/or chromaticity and the area ratios of the subpixels may be changed. Also, a plurality of subpixels of the same color may be arranged. In this case, the number of the subpixels making up one pixel may be four or more. The gray level value, luminance value, and gamma value are merely examples and not limited to those shown in the exemplary embodiments. Moreover, in the third exemplary embodiment, instead of Step B4 in FIG. 12, the same processing as the Step B11 in FIG. 11 of the second exemplary embodiment may be performed.

Incidentally, the present invention is not limited to the liquid crystal display device and can be applied to any image display device having a display panel made up of a plurality of basic color subpixels and white subpixels. In particular, the gray level signal converting section employed in the present invention can be applied to any display panel such as a plasma display device, EL (electroluminescent) device so long as each pixel of the display panel is made up of the same type of subpixels as used in the above exemplary embodiment.

What is claimed is:

1. An image display device comprising:

a display panel having a plurality of pixels, each pixel comprising three basic color subpixels to display three primary colors for obtaining white display by additive mixture of colors and one white subpixel to display a white color;

a four color gray level signal generating unit, to generate four color gray level signals corresponding to said three basic color subpixels and one white subpixel from an inputted three color gray level signal corresponding to three primary colors; and a driving unit to supply a corresponding subpixel gray level signal to each of said three basic color subpixels and one white subpixel when said four color gray level signals are inputted from said four color gray level signal generating unit, wherein said four color gray level signal generating unit comprises:

a gamma converting unit to perform gamma conversion on said three color gray level signal to convert three color gray level values into three color luminance values;

a maximum and minimum luminance value calculating unit to calculate a maximum luminance value and minimum luminance value from among said three color luminance values inputted from the gamma converting unit;

a first four color luminance value calculating unit to calculate first four color luminance values consisting essentially of first three color luminance values corresponding to said three basic color subpixels and a first white color luminance value corresponding to said one white subpixel, wherein said first three color luminance values are calculated based on a full white ratio set in advance, the inputted three color luminance values and said minimum luminance value, the full white ratio being defined as a ratio of one full white display luminance produced by only said white subpixel to another full white display luminance produced by said three basic color subpixels, whereas said first white color luminance value is calculated based on said minimum luminance value;

a correction coefficient calculating unit to calculate a correction coefficient being used to correct the first four color luminance values each to make the value be a specified upper limit or less based on a maximum value of said first four color luminance values and said maximum luminance value;

a second four color luminance value calculating unit to calculate second four color luminance values based on said first four color luminance values and said correction coefficient, the second four color luminance values consisting essentially of second three color luminance values and a second white color luminance value; and a reverse gamma converting unit to perform reverse gamma conversion on said second four color luminance values to generate said four color gray level signals, wherein said correction coefficient calculating unit is configured, when said maximum luminance value is greater than 0, to calculate said correction coefficient by dividing said maximum value of said first four color luminance values by said maximum luminance value and, when said maximum luminance value is 0, to set said correction coefficient as 1, and wherein said first four color luminance value calculating unit calculates said first four color luminance values according to the following Equations:

$$LR'=LR\times(1+L)-M_2\times L$$

$$LG'=LG\times(1+L)-M_2\times L$$

$$LB'=LB\times(1+L)-M_2\times L$$

$$LW'=M_2,$$

where L=full white ratio, $M_2$=the minimum luminance value of the three color luminance values, and LR, LG, and LB each denote any one of the inputted three color luminance values.

2. An image display device comprising:

a display panel having a plurality of pixels, each pixel comprising three basic color subpixels to display three primary colors for obtaining white display by additive mixture of colors and one white subpixel to display a white color;

a four color gray level signal generating unit, to generate four color gray level signals corresponding to said three basic color subpixels and one white subpixel from an inputted three color gray level signal corresponding to three primary colors; and a driving unit to supply a corresponding subpixel gray level signal to each of said three basic color subpixels and one white subpixel when said four color gray level signals are inputted from said four color gray level signal generating unit, wherein said four color gray level signal generating unit comprises:

a gamma converting unit to perform gamma conversion on said three color gray level signal to convert three color gray level values into three color luminance values;

a maximum and minimum luminance value calculating unit to calculate a maximum luminance value and minimum luminance value from among said three color luminance values inputted from the gamma converting unit;

a first four color luminance value calculating unit to calculate first four color luminance values consisting essentially of first three color luminance values corresponding to said three basic color subpixels and a first white color luminance value corresponding to said one white subpixel, wherein said first three color luminance values are calculated based on a full white ratio set in advance, the inputted three color luminance values and said minimum luminance value, the full white ratio being defined as a ratio of one full white display luminance produced by only said white subpixel to another full white display luminance produced by said three basic color subpixels, whereas said first white color luminance value is calculated based on said minimum luminance value;

a correction coefficient calculating unit to calculate a correction coefficient being used to correct the first four color luminance values each to make the value be a specified upper limit or less based on a maximum value of said first four color luminance values and said maximum luminance value;

a second four color luminance value calculating unit to calculate second four color luminance values based on said first four color luminance values and said correction coefficient, the second four color luminance values consisting essentially of second three color luminance values and a second white color luminance value; and a reverse gamma converting unit to perform reverse gamma conversion on said second four color luminance values to generate said four color gray level signals, wherein said second four color luminance value calculating unit is configured to calculate said second four color luminance values by dividing respectively said first four color luminance values by said correction coefficient, and wherein said first four color luminance value calculating unit calculates said first four color luminance values according to the following Equations:

$$LR'=LR\times(1+L)-M_2\times L$$

$$LG'=LG\times(1+L)-M_2\times L$$

$$LB'=LB\times(1+L)-M_2\times L$$

$$LW'=M_2,$$

where L=full white ratio, $M_2$=the minimum luminance value of the three color luminance values, and LR, LG, and LB each denote any one of the inputted three color luminance values.

3. An image display device comprising:

a display panel having a plurality of pixels, each pixel comprising three basic color subpixels to display three primary colors for obtaining white display by additive mixture of colors and one white subpixel to display a white color;

a four color gray level signal generating unit, to generate four color gray level signals corresponding to said three basic color subpixels and one white subpixel from an inputted three color gray level signal corresponding to three primary colors; and a driving unit to supply a corresponding subpixel gray level signal to each of said three basic color subpixels and one white subpixel when said four color gray level signals are inputted from said four color gray level signal generating unit, wherein said four color gray level signal generating unit comprises:

a gamma converting unit to perform gamma conversion on said three color gray level signal to convert three color gray level values into three color luminance values;

a maximum and minimum luminance value calculating unit to calculate a maximum luminance value and minimum luminance value from among said three color luminance values inputted from the gamma converting unit;

a first four color luminance value calculating unit to calculate first four color luminance values consisting essentially of first three color luminance values corresponding to said three basic color subpixels and a first white color luminance value corresponding to said one white subpixel, wherein said first three color luminance values are calculated based on a full white ratio set in advance, the inputted three color luminance values and said minimum luminance value, the full white ratio being defined as a ratio of one full white display luminance produced by only said white subpixel to another full white display luminance produced by said three basic color subpixels, whereas said first white color luminance value is calculated based on said minimum luminance value;

a correction coefficient calculating unit to calculate a correction coefficient being used to correct the first four color luminance values each to make the value be a specified upper limit or less based on a maximum value of said first four color luminance values and said maximum luminance value;

a second four color luminance value calculating unit to calculate second four color luminance values based on said first four color luminance values and said correction coefficient, the second four color luminance values consisting essentially of second three color luminance values and a second white color luminance value; and a reverse gamma converting unit to perform reverse gamma conversion on said second four color luminance values to generate said four color gray level signals, wherein a three primary color use luminance ratio is set in which a degree at which gray level values of said three primary colors are used when said four color gray level signal is generated based on said three color gray level signal is represented as a ratio of a luminance value, wherein said correction coefficient calculating unit, when said maximum luminance value is greater than 0, calculates said correction coefficient in a manner to be proportional to said three primary use luminance ratio, and wherein said first four color luminance value calculating unit calculates said first four color luminance values according to the following Equations:

$$LR'=LR\times(1+L)-M_2\times L$$

$$LG'=LG\times(1+L)-M_2\times L$$

$$LB'=LB\times(1+L)-M_2\times L$$

$$LW'=M_2,$$

where L=full white ratio, $M_2$=the minimum luminance value of the three color luminance values, and LR, LG, and LB each denote any one of the inputted three color luminance values.

4. An image display device comprising:

a display panel having a plurality of pixels, each pixel comprising three basic color subpixels to display three primary colors for obtaining white display by additive mixture of colors and one white subpixel to display a white color;

a four color gray level signal generating unit, to generate four color gray level signals corresponding to said three basic color subpixels and one white subpixel from an inputted three color gray level signal corresponding to three primary colors;

a driving unit to supply a corresponding subpixel gray level signal to each of said three basic color subpixels and one white subpixel when said four color gray level signals are inputted from said four color gray level signal generating unit, and a white subpixel use ratio upper limit value calculating section, wherein said four color gray level signal generating unit comprises:

a gamma converting unit to perform gamma conversion on said three color gray level signal to convert three color gray level values into three color luminance values;

a maximum and minimum luminance value calculating unit to calculate a maximum luminance value and minimum luminance value from among said three color luminance values inputted from the gamma converting unit;

a first four color luminance value calculating unit to calculate first four color luminance values consisting essentially of first three color luminance values corresponding to said three basic color subpixels and a first white color luminance value corresponding to said one white subpixel, wherein said first three color luminance values are calculated based on a full white ratio set in advance, the inputted three color luminance values and said minimum luminance value, the full white ratio being defined as a ratio of one full white display luminance produced by only said white subpixel to another full white display luminance produced by said three basic color subpixels, whereas said first white color luminance value is calculated based on said minimum luminance value;

a correction coefficient calculating unit to calculate a correction coefficient being used to correct the first four color luminance values each to make the value be a specified upper limit or less based on a maximum value of said first four color luminance values and said maximum luminance value;

a second four color luminance value calculating unit to calculate second four color luminance values based on said first four color luminance values and said correction coefficient, the second four color luminance values consisting essentially of second three color luminance values and a second white color luminance value; and a reverse gamma converting unit to perform reverse gamma conversion on said second four color luminance values to generate said four color gray level signals, and wherein said white subpixel use ratio upper limit value calculating section calculates, based on said maximum luminance value and minimum luminance value calculated by said maximum and minimum luminance value calculating unit, a ratio of said maximum luminance value to said minimum luminance value as an upper limit value of a ratio of using a white subpixel to be employed by said first four color luminance value calculating unit, wherein said first four color luminance value calculating unit calculates said first four color luminance values in a manner in which said minimum luminance value is made to be proportional to any ratio being said upper limit value or less, and wherein said first four color luminance value calculating unit calculates said first four color luminance values according to the following Equations:

$$LR'=LR\times(1+L)-M_2\times L$$

$$LG'=LG\times(1+L)-M_2\times L$$

$$LB'=LB\times(1+L)-M_2\times L$$

$$LW'=M_2,$$

where L=full white ratio, $M_2$=the minimum luminance value of the three color luminance values, and LR, LG, and LB each denote any one of the inputted three color luminance values.

5. An image display method to be employed by an image display device formed of a display panel having a plurality of pixels, each pixel comprising three basic color subpixels to display three primary colors for obtaining white display by additive mixture of colors and one white subpixel to display a white color, said method comprising:

four color gray level signal generating processing of generating four color gray level signals corresponding to said three basic color subpixels and one white subpixel from an inputted three color gray level signal corresponding to three primary colors; and driving processing of supplying a corresponding subpixel gray level signal to each of said three basic color subpixels and one white subpixel when said four color gray level signals are inputted, wherein said four color gray level signal generating processing comprises:

gamma converting processing of performing gamma conversion on said three color gray level signal to convert three color gray level values into three color luminance values;

maximum and minimum luminance value calculating processing of calculating a maximum luminance value and minimum luminance value from among said three color luminance values outputted by the gamma converting processing;

first four color luminance value calculating processing of calculating first four color luminance values consisting essentially of first three color luminance values corresponding to said three basic color subpixels and a first white color luminance value corresponding to said one white subpixel, wherein said first three color luminance values are calculated based on a full white ratio set in advance, the inputted three color luminance values and said minimum luminance value, the full white ratio being defined as a ratio of one full white display luminance produced by only said white subpixel to another full white display luminance produced by said three basic color subpixels, whereas said first white color luminance value is calculated based on said minimum luminance value;

correction coefficient calculating processing of calculating a correction coefficient being used to correct the first four color luminance values each to make the value be a specified upper limit or less based on a maximum value of said first four color luminance values and said maximum luminance value;

second four color luminance value calculating processing of calculating second four color luminance values based on said first four color luminance values and said correction coefficient, the second four color luminance values consisting essentially of second three color luminance values and a second white color luminance value; and reverse gamma converting processing of performing reverse gamma conversion on said second four color luminance values to generate said four color gray level signals, wherein, in said correction coefficient calculating processing, when said maximum luminance value is greater than 0, said correction coefficient is calculated by dividing said maximum value of said first four color luminance values by said maximum luminance value and, when said maximum luminance value is 0, said correction coefficient is set as 1, and wherein, in said first four color luminance value calculating processing, said first four color luminance values are calculated according to the following Equations:

$$LR'=LR\times(1+L)-M_2\times L$$

$$LG'=LG\times(1+L)-M_2\times L$$

$$LB'=LB\times(1+L)-M_2\times L$$

$$LW'=M_2,$$

where L=full white ratio, $M_2$=the minimum luminance value of the three color luminance values, and LR, LG, and LB each denote any one of the inputted three color luminance values.

6. An image display method to be employed by an image display device formed of a display panel having a plurality of pixels, each pixel comprising three basic color subpixels to display three primary colors for obtaining white display by additive mixture of colors and one white subpixel to display a white color, said method comprising:

four color gray level signal generating processing of generating four color gray level signals corresponding to said three bask color subpixels and one white subpixel from an inputted three color gray level signal corresponding to three primary colors; and driving processing of supplying a corresponding subpixel gray level signal to each of said three basic color subpixels and one white subpixel when said four color gray level signals are inputted, wherein said four color gray level signal generating processing comprises:

gamma converting processing of performing gamma conversion on said three color gray level signal to convert three color gray level values into three color luminance values;

maximum and minimum luminance value calculating processing of calculating a maximum luminance value and minimum luminance value from among said three color luminance values outputted by the gamma converting processing;

first four color luminance value calculating processing of calculating first four color luminance values consisting essentially of first three color luminance values corresponding to said three basic color subpixels and a first white color luminance value corresponding to said one white subpixel, wherein said first three color luminance values are calculated based on a full white ratio set in advance, the inputted three color luminance values and said minimum luminance value, the full white ratio being defined as a ratio of one full white display luminance produced by only said white subpixel to another full white display luminance produced by said three basic color subpixels, whereas said first white color luminance value is calculated based on said minimum luminance value;

correction coefficient calculating processing of calculating a correction coefficient being used to correct the first four color luminance values each to make the value be a specified upper limit or less based on a maximum value of said first four color luminance values and said maximum luminance value;

second four color luminance value calculating processing of calculating second four color luminance values based on said first four color luminance values and said correction coefficient, the second four color luminance values consisting essentially of second three color luminance values and a second white color luminance value; and reverse gamma converting processing of performing reverse gamma conversion on said second four color luminance values to generate said four color gray level signals, wherein, in said second four color luminance value calculating processing, said second four color luminance values are calculated by dividing respectively said first four color luminance values by said correction coefficient, and wherein, in said first four color luminance value calculating processing, said first four color luminance values are calculated according to the following Equations:

$$LR'=LR\times(1+L)-M_2\times L$$

$$LG'=LG\times(1+L)-M_2\times L$$

$$LB'=LB\times(1+L)-M_2\times L$$

$$LW'=M_2,$$

where L=full white ratio, $M_2$=the minimum luminance value of the three color luminance values, and LR, LG, and LB each denote any one of the inputted three color luminance values.

7. An image display method to be employed by an image display device formed of a display panel having a plurality of pixels, each pixel comprising three basic color subpixels to display three primary colors for obtaining white display by additive mixture of colors and one white subpixel to display a white color, said method comprising:

four color gray level signal generating processing of generating four color gray level signals corresponding to said three basic color subpixels and one white subpixel from an inputted three color gray level signal corresponding to three primary colors; and driving processing of supplying a corresponding subpixel gray level signal to each of said three basic color subpixels and one white subpixel when said four color gray level signals are inputted, wherein said four color gray level signal generating processing comprises:

gamma converting processing of performing gamma conversion on said three color gray level signal to convert three color gray level values into three color luminance values;

maximum and minimum luminance value calculating processing of calculating a maximum luminance value and minimum luminance value from among said three color luminance values outputted by the gamma converting processing;

first four color luminance value calculating processing of calculating first four color luminance values consisting essentially of first three color luminance values corresponding to said three basic color subpixels and a first white color luminance value corresponding to said one white subpixel, wherein said first three color luminance values are calculated based on a full white ratio set in advance, the inputted three color luminance values and said minimum luminance value, the full white ratio being defined as a ratio of one full white display luminance produced by only said white subpixel to another full white display luminance produced by said three basic color subpixels, whereas said first white color luminance value is calculated based on said minimum luminance value;

correction coefficient calculating processing of calculating a correction coefficient being used to correct the first four color luminance values each to make the value be a specified upper limit or less based on a maximum value of said first four color luminance values and said maximum luminance value;

second four color luminance value calculating processing of calculating second four color luminance values based on said first four color luminance values and said correction coefficient, the second four color luminance values consisting essentially of second three color luminance values and a second white color luminance value; and reverse gamma converting processing of performing reverse gamma conversion on said second four color luminance values to generate said four color gray level signals, wherein a three primary color use luminance ratio is set in which a degree at which gray level value of said three primary colors are used when said four color gray level signal is generated based on said three color gray level signal is represented as a ratio of a luminance value, wherein, in said correction coefficient calculating processing, when said maximum luminance value is greater than 0, said correction coefficient is calculated in a manner to be proportional to said three primary use luminance ratio, and wherein, in said first four color luminance value calculating processing, said first four color luminance values are calculated according to the following Equations:

$$LR'=LR\times(1+L)-M_2\times L$$

$$LG'=LG\times(1+L)-M_2\times L$$

$$LB'=LB\times(1+L)-M_2\times L$$

$$LW'=M_2,$$

where L=full white ratio, $M_2$=the minimum luminance value of the three color luminance values, and LR, LG, and LB each denote any one of the inputted three color luminance values.

8. An image display method to be employed by an image display device formed of a display panel having a plurality of pixels, each pixel comprising three basic color subpixels to display three primary colors for obtaining white display by additive mixture of colors and one white subpixel to display a white color, said method comprising:

four color gray level signal generating processing of generating four color gray level signals corresponding to said three basic color subpixels and one white subpixel from an inputted three color gray level signal corresponding to three primary colors; and driving processing of supplying a corresponding subpixel gray level signal to each of said three basic color subpixels and one white subpixel when said four color gray level signals are inputted, wherein said four color gray level signal generating processing comprises:

gamma converting processing of performing gamma conversion on said three color gray level signal to convert three color gray level values into three color luminance values;

maximum and minimum luminance value calculating processing of calculating a maximum luminance value and minimum luminance value from among said three color luminance values outputted by the gamma converting processing;

first four color luminance value calculating processing of calculating first four color luminance values consisting essentially of first three color luminance values corresponding to said three basic color subpixels and a first white color luminance value corresponding to said one white subpixel, wherein said first three color luminance values are calculated based on a full white ratio set in advance, the inputted three color luminance values and said minimum luminance value, the full white ratio being defined as a ratio of one full white display luminance produced by only said white subpixel to another full white display luminance produced by said three basic color subpixels, whereas said first white color luminance value is calculated based on said minimum luminance value;

correction coefficient calculating processing of calculating a correction coefficient being used to correct the first four color luminance values each to make the value be a specified upper limit or less based on a maximum value of said first four color luminance values and said maximum luminance value;

second four color luminance value calculating processing of calculating second four color luminance values based on said first four color luminance values and said correction coefficient, the second four color luminance values consisting essentially of second three color luminance values and a second white color luminance value; and reverse gamma converting processing of performing reverse gamma conversion on said second four color luminance values to generate said four color gray level signals, wherein white subpixel use ratio upper limit value calculating processing is performed to calculate, based on said maximum luminance value and minimum luminance value calculated by said maximum and minimum luminance value calculating processing, a ratio of said maximum luminance value to said minimum luminance value as an upper limit value of a ratio of using a white subpixel to be employed by said first four color luminance value calculating processing, wherein, in said first four color luminance value calculating processing, said first four color luminance value is calculated in a manner in which said minimum luminance value is made to be proportional to any ratio being said upper limit value or less, and wherein, in said first four color luminance value calculating processing, said first four color luminance values are calculated according to the following Equations:

$$LR'=LR\times(1+L)-M_2\times L$$

$$LG'=LG\times(1+L)-M_2\times L$$

$$LB'=LB\times(1+L)-M_2\times L$$

$$LW'=M_2,$$

where L=full white ratio, $M_2$=the minimum luminance value of the three color luminance values, and LR, LG, and LB each denote any one of the inputted three color luminance values.

* * * * *